US007180462B2

(12) United States Patent
Kaneko et al.

(10) Patent No.: US 7,180,462 B2
(45) Date of Patent: Feb. 20, 2007

(54) UHF BROADBAND ANTENNA

(75) Inventors: Atsushi Kaneko, Saitama (JP); Shuji Hagiwara, Saitama (JP); Mikihiro Matsuura, Saitama (JP)

(73) Assignee: Yagi Anntena Inc., Saitama (JP)

( * ) Notice: Subject to any disclaimer, the term of this patent is extended or adjusted under 35 U.S.C. 154(b) by 0 days.

(21) Appl. No.: 11/043,140

(22) Filed: Jan. 27, 2005

(65) Prior Publication Data

US 2005/0162333 A1 Jul. 28, 2005

(30) Foreign Application Priority Data

Jan. 27, 2004 (JP) ..... P2004-018592
Jul. 30, 2004 (JP) ..... P2004-223940

(51) Int. Cl.
*H01Q 9/26* (2006.01)

(52) U.S. Cl. ..... 343/803; 343/793

(58) Field of Classification Search ..... 343/795, 343/803, 818, 793
See application file for complete search history.

(56) References Cited

U.S. PATENT DOCUMENTS 4,940,992 A * 7/1990 Nguyen et al. ..... 343/803
6,281,857 B1 * 8/2001 Dobrovolny ..... 343/795
6,317,099 B1 * 11/2001 Zimmerman et al. ..... 343/803
6,624,793 B1 * 9/2003 Su et al. ..... 343/795
6,650,301 B1 * 11/2003 Zimmerman ..... 343/803
6,937,204 B2 * 8/2005 Hall ..... 343/795

FOREIGN PATENT DOCUMENTS

JP 2003-273637 A 9/2003

* cited by examiner

*Primary Examiner*—Hoang V. Nguyen
(74) *Attorney, Agent, or Firm*—Sughrue Mion, PLLC

(57) ABSTRACT

In a UHF broadband antenna, a pair of dipole elements are provided. Each of the dipole elements is shaped into a rectangular plate. A power feeding point is provided on each of the dipole elements

6 Claims, 30 Drawing Sheets

UHF BROADBAND ANTENNA

BACKGROUND OF THE INVENTION

The present invention is related to an UHF broadband antenna which is used in, for example, UHF band ground wave broadcasting and communications.

ISTB-T (Terrestrial Integrated Services Digital Broadcasting) programs have already been commenced since 2003 in limited regions of Japan, and are scheduled to be started in other regions of Japan until 2006.

As to the above-described Terrestrial Integrated Services Digital Broadcasting system, electromagnetic waves in UHF band are used, and a frequency range thereof is scheduled to be enlarged to 470 through 770 MHz.

Conventionally, two-element type dipole antennas are known as antennas which receive electromagnetic waves in the UHF band (refer to, for instance, Japanese Patent Publication No. 2003-273637A).

One conventional two-element type dipole antenna is constructed as shown in FIGS. 27A to 27C. In this type of antenna, first dipole elements 1*a*, 1*b*, and second dipole elements 2*a*, 2*b*, which are made of conductor pipes, are arranged in parallel to each other by spacing a predetermined interval. A center portion of these dipole elements is held by a retainer 3 made of an insulative material. The first dipole element 1*a* is electrically conducted to the second dipole element 2*a* by a metal plate 4*a*, and the first dipole element 1*b* is electrically conducted to the second dipole element 2*b* by another metal plate 4*b*. Then, electric power is supplied to feeding points 5 provided on the side of the first dipole elements 1*a*, 1*b* from a feeder 6.

FIG. 28 shows a horizontal polarization vertical plane directivity of the above-described two-element type dipole antenna at the frequency of 770 MHz. In the above-described two-element type dipole antenna, the higher the frequency thereof within the band is increased, the larger a difference between phases of electromagnetic waves becomes, namely one phase of an electromagnetic wave radiated from the first dipole elements 1*a*, 1*b* on the side of the feeding point, another phase of an electromagnetic wave radiated from the second dipole elements 2*a*, 2*b* on the side of the non-feeding point. As a result, in the case that the frequency range is broadened, as indicated in FIG. 28, a maximum value direction of the directivity (vertical plane) is tilted along a direction of an azimuth angle 90 degrees in the vicinity of an upper end frequency.

Generally speaking, the above-described two-element type dipole antenna is known as a broadband characteristic and a high gain characteristic. However, since this antenna is constituted by both the first dipole elements 1*a*, 1*b* and the second dipole elements 2*a*, 2*b*, which are made by employing the conductor pipes, there is such a drawback that a total number of structural components of this antenna becomes large, as compared with those of a half-wave length dipole antenna and of a biconical type antenna. Also, since a feeding impedance in the two-element type dipole antenna owns a broadband characteristic in the order of 200 to 300 Ω, an impedance conversion circuit is required in order to convert these high impedances into 75 Ω which is generally utilized.

Also, since the two-element type dipole antenna owns an unidirectional characteristic along such a direction defined from the first dipole elements 1*a*, 1*b* to the second dipole elements 2*a*, 2*b*, in such a case that both the first dipole elements 1*a*, 1*b* and the second dipole elements 2*a*, 2*b* are arranged within the same plane with respect to the electric field plane, this antenna element arrangement may cause a less electrical problem. However, in the case that the two-element type dipole antenna is used as a primary driven element, there are such problems that the two-element type dipole antenna becomes bulky, or the directivity and the gain characteristic of this two-element type dipole antenna are deteriorated, depending upon a mounting condition of the antenna.

FIGS. 29A and 29B show such an example that both the first dipole elements 1*a*, 1*b*, and the second dipole elements 2*a*, 2*b* are arranged within the same plane which is parallel to the electric field plane, in such a case that the above-described two-element type dipole antenna is used as a primary driven element. The two-element type dipole antenna is supported on a reflecting plate 7 via a supporting pillar 8.

In such a case that the first dipole elements 1*a*, 1*b* and the second dipole element 2*a*, 2*b* are arranged within the same plane with respect to the electric field plane, although the directivity is not deteriorated, there is such a problem that the two-element type dipole antenna becomes bulky, due to pressure of such distances between the first dipole elements 1*a*, 1*b* and the second dipole elements 2*a*, 2*b*.

FIGS. 30A and 30B show such an example that both the first dipole elements 1*a*, 1*b*, and the second dipole elements 2*a*, 2*b* are arranged with the same plane which is perpendicular to the electric field plane, in such a case that the above-described two-element type dipole antenna is used as a primary driven element.

FIG. 31 shows a horizontal polarization vertical plane directivity of the two-element type dipole antenna shown in FIGS. 30A and 30B at a frequency of 770 MHz. Since both the first dipole elements 1*a*, 1*b* and the second dipole elements 2*a*, 2*b* are provided at the same distances from the reflecting plate 7, the resulting antenna can be made compact. However, since the two-element type dipole antenna owns such a directivity (vertical plane) as shown in FIG. 28, even when this two-element type dipole antenna is used as the primary driven element, a maximum value direction of the directivity (vertical plane) is tilted along such an azimuth angle direction of approximately 25 degrees in the vicinity of an upper end frequency. As a result, this two-element type dipole antenna owns such a problem that a gain thereof is excessively lowered, as compared with the dipole antenna shown in FIGS. 29A and 29B, namely, the first dipole elements 1*a*, 1*b* and the second dipole elements 2*a*, 2*b* are arranged within the same plane with respect to the electric field plane.

Also, since the above-described two-element type dipole antenna requires the length corresponding to approximately 0.5 λ (symbol "λ" indicates wavelength of used frequency) of the lower end frequency within the frequency band, if this dipole antenna is required to be made compact, then this 0.5λ-length requirement may constitute a problem.

SUMMARY OF THE INVENTION

It is therefore an object of the invention to provide a UHF broadband (wide-band) antenna having a simple and compact structure, and also having high performance, which is capable of preventing a deterioration of a directivity thereof.

In order to achieve the above object, according to the invention, there is provided a UHF broadband antenna, comprising:

a pair of dipole elements, each of which is shaped into a rectangular plate; and a power feeding point, provided on each of the dipole elements.

With the above configuration, the broadband characteristic can be realized while the antenna can be made compact. Also, since the structure of the antenna is simple, this antenna can be easily manufactured with low cost.

Preferably, a strip-shaped conductive member having at least one bent portion and a width which is narrower than a width of each of the dipole elements is fixed to one faces of the dipole elements.

Preferably, each of the dipole elements is formed with a hole at a central position thereof.

Preferably, a conductive reflection plate having a width which is wider than a width of each of the dipole elements is disposed behind the dipole elements with a gap.

Preferably, each of the dipole elements is partly folded rearward.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE INVENTION

Embodiments of the invention will be described below in detail with reference to the accompanying drawings.

Figure 1A:
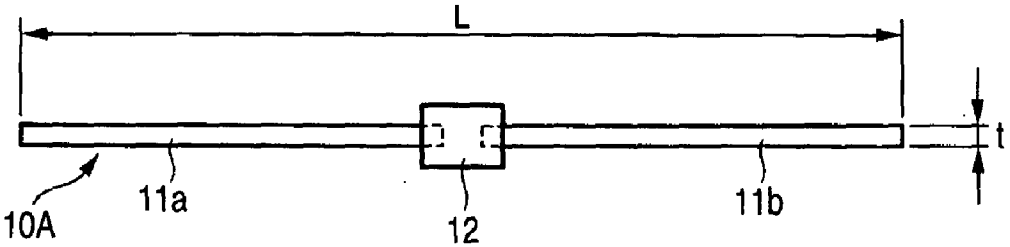
FIG. 1A is a top view of an antenna according to a first embodiment of the invention.
Figure 1B:
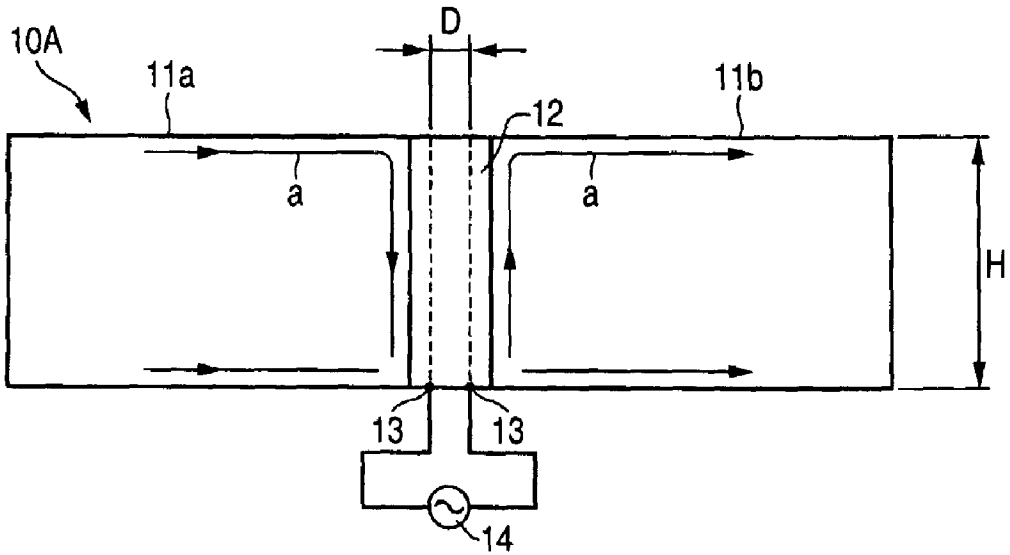
FIG. 1B is a front view of the antenna of FIG. 1A.
Figure 1C:
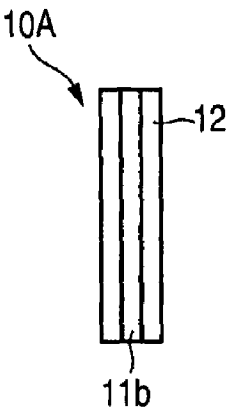
FIG. 1C is a side view of the antenna of FIG. 1A.

FIGS. 1A to 1C show a UHF broadband antenna 10A according to a first embodiment of the present invention. In this embodiment, plate-shaped dipole elements 11*a*, 11*b* each of which is a metal plate having a shape of, for example, substantially rectangle. The plate-shaped dipole elements 11*a*, 11*b* are arranged, while a predetermined interval "D" therebetween is maintained. A center portion of the antenna 10A, edge portions of these dipole elements 11*a*, 11*b* located opposite to each other are held by a retainer 12 made of an insulative material. The above-described dipole elements 11*a*, 11*b* have been designed as follows. That is, for instance, an entire length "L" of these dipole elements 11*a*, 11*b* has been set to approximately 0.35 λa; a height "H" has been set to be longer than, or equal to approximately 0.06 λa; a thickness "t" has been set to be smaller than, or equal to approximately 0.002 λa; and also, the interval "D" has been set to 0.006 to 0.025 λa. It should be understood that the above-described symbol "λa" indicates, for instance, a wavelength of a lower end frequency 470 MHz in the UHF frequency band defined from 470 MHz to 770 MHz. Also, it should be noted that the interval "D" between the dipole elements 11*a*, 11*b* need not be set to a constant value, for example, the upper portion is set to 0.006 λa, and the lower portion is set to 0.025 λa.

Values of the respective portions of the above-described dipole elements 11*a*, 11*b* are preferably set as follows: That is, the entire length "L" thereof is set to approximately 0.35 λa; the height "H" is set to approximately 0.1 λa; the thickness "t" is set to approximately 0.015 λa; and the interval "D" is set to approximately 0.008 λa.

Then, a feeding point 13 is provided between a center portion and a lower edge portion of the retainer 12. Electric power is fed from a feeder 14 via the feeding point 13 to the dipole elements 11*a*, 11*b*.

Figure 2A:
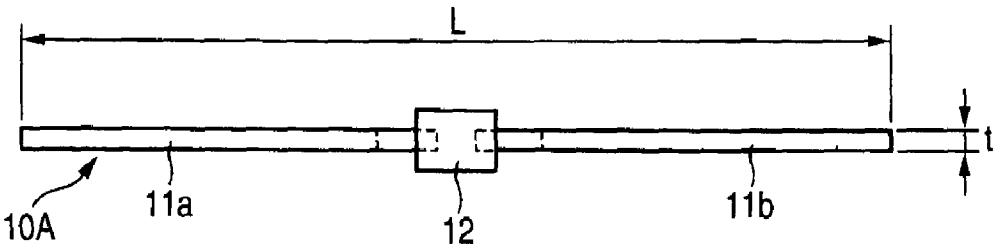
FIG. 2A is a top view of an antenna according to a modified example of the antenna of FIG. 1A.
Figure 2B:
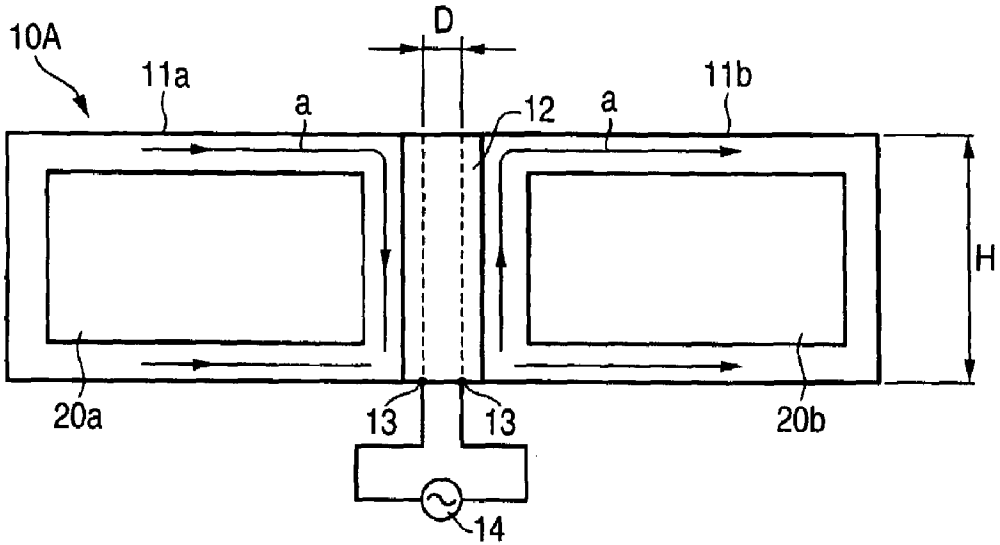
FIG. 2B is a front view of the antenna of FIG. 2A.
Figure 2C:
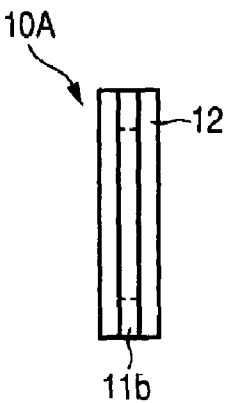
FIG. 2C is a side view of the antenna of FIG. 2A.

Alternatively, as shown in FIG. 2A to 2C, rectangular holes 20*a*, 20*b* may be formed in the center portions of the plate-shaped dipole elements 11*a*, 11*b*, namely, may be formed in such portions of the dipole elements 11*a*, 11*b* that currents can be hardly induced.

Both lateral widths and heights of the holes 20*a*, 20*b* are set to be smaller than, or equal to approximately ⅔ of lateral widths and heights of the dipole elements 11*a*, 11*b*. As explained above, even if the holes 20*a*, 20*b* are formed in the center portions of the plate-shaped dipole elements 11*a*, 11*b*, similar operations and effects to those of the antenna with employment of the plate-shaped dipole elements 11*a*, 11*b* shown in FIGS. 1A to 1C may be achieved. Also, since the holes 20*a*, 20*b* are formed in the center portions of the dipole elements 11*a*, 11*b*, the dipole elements 11*a*, 11*b* can be made in light weight, and also, wind receiving areas thereof can be reduced. It should also be noted that the shapes of the above-described holes 20*a*, 20*b* may be alternatively selected from, for instance, a circle, an ellipse, a trapezoid, and the like other than the rectangle.

In the UHF broadband antenna 10A, when electric power is supplied to the feeding point 13 of the dipole elements 11*a*, 11*b* from the feeding point 14, as indicated by an arrow "a" in FIGS. 1B and 2B, a feeding current flows from the feeding point 13 along peripheral portions of the dipole elements 11*a*, 11*b*, so that the antenna 10A is operated in a similar manner to that of the two-element type dipole antenna.

Also, when the entire length "L" of the dipole elements 11*a*, 11*b* are set to be such a value shorter than a half wavelength, for example, 0.35 λa, a resonant frequency band is shifted to a higher frequency band. However, since the height "H" of the dipole elements 11*a*, 11*b* is set to be sufficiently high, namely, higher than, or equal to 0.06 λa, as compared with a diameter (approximately 0.015 λa) of the dipole element which is constituted by the conductor pipe, the antenna 10A may have a reactance component so as to correct an electric length of this antenna 10A. Also, since the interval "D" between the dipole elements 11*a*, 11*b* is set to be a range between 0.006 λa and 0.025 λa, and also, the height "H" thereof is set to be higher than, or equal to 0.06 λa, although the UHF broadband antenna 10A owns the same shape as that of the dipole antenna, this broadband antenna 10A can achieve a similar effect to that of the two-element type dipole antenna, can broaden the frequency band, and further, can correct the impedance. As a result, while the dimension of this broadband antenna 10A can be made compact, a superior VSWR (voltage standing-wave ratio) characteristic thereof can be realized.

Figure 3:
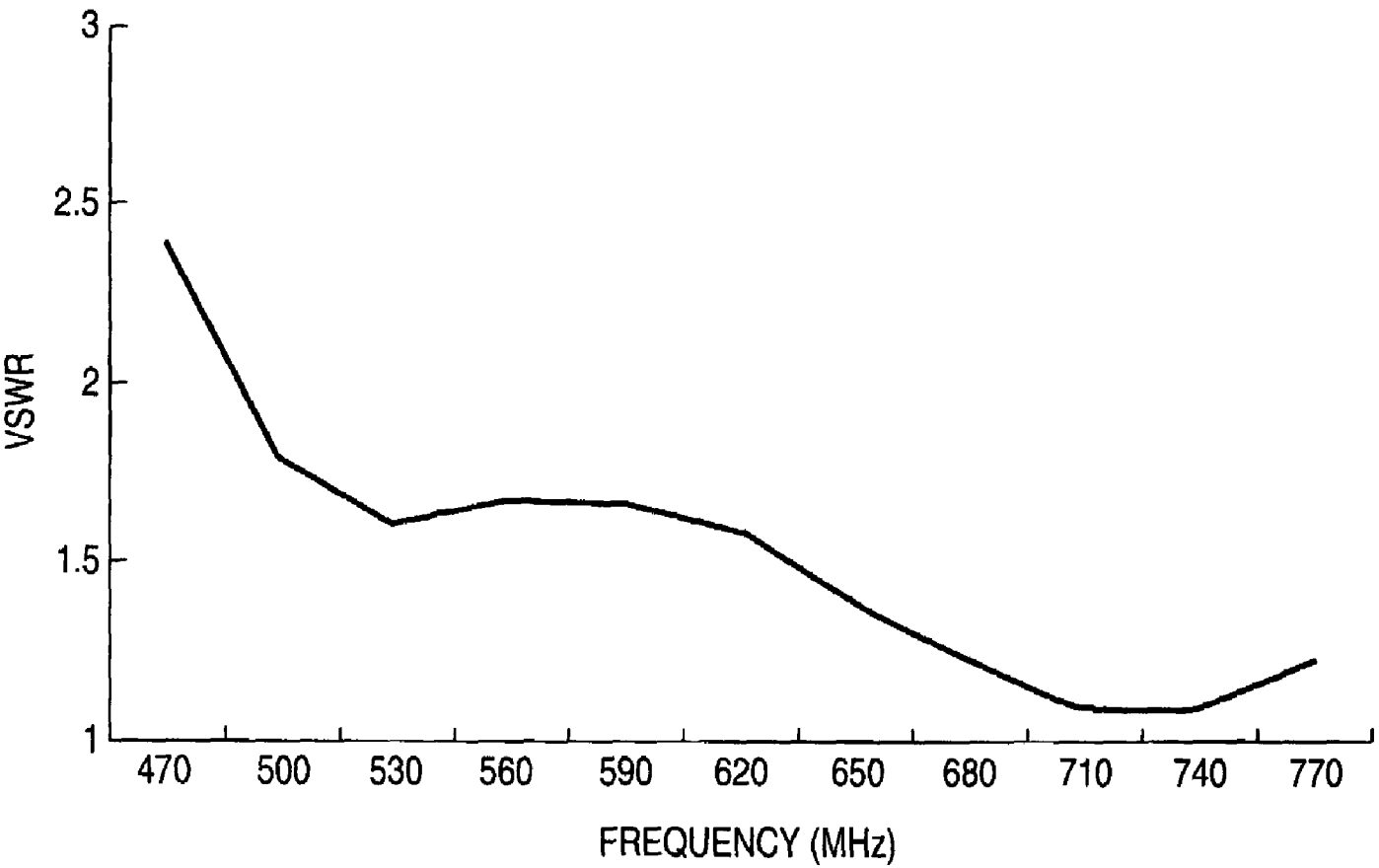
FIG. 3 is a graph showing a voltage standing-wave ratio characteristic of the antenna of FIG. 1A.

FIG. 3 shows a VSWR characteristic of the above-described UHF broadband antenna 10A according to the first embodiment in such a case that the entire length "L" of the dipole elements 11*a*, 11*b* is set to 0.35 λa; the height "H" thereof is set to 0.1 λa; the thickness "t" thereof is set to 0.0015 λa; the interval "D" thereof is set to 0.008 λa; and also, the UHF frequency band thereof is set from 470 MHz to 770 MHz; an abscissa of this VSWR characteristic indicates a frequency (MHz), whereas an ordinate thereof indicates a VSWR (voltage standing-wave ratio). This VSWR characteristic shows a superior characteristic over the UHF frequency band defined from 470 MHz to 770 MHz.

Figure 4:
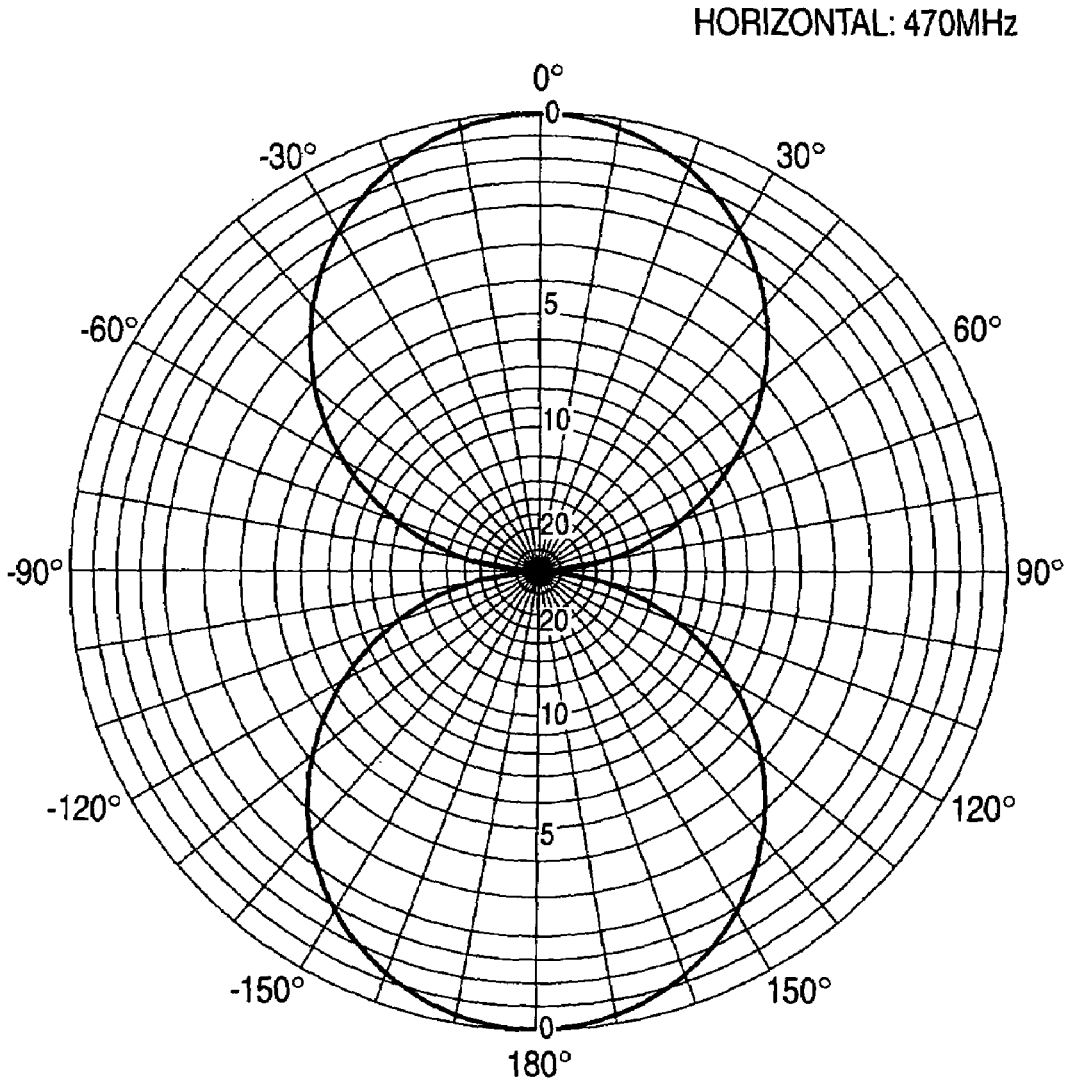
FIG. 4 is a graph showing a horizontal polarization horizontal plane directivity of the antenna of FIG. 1A at the frequency of 470 MHz.
Figure 5:
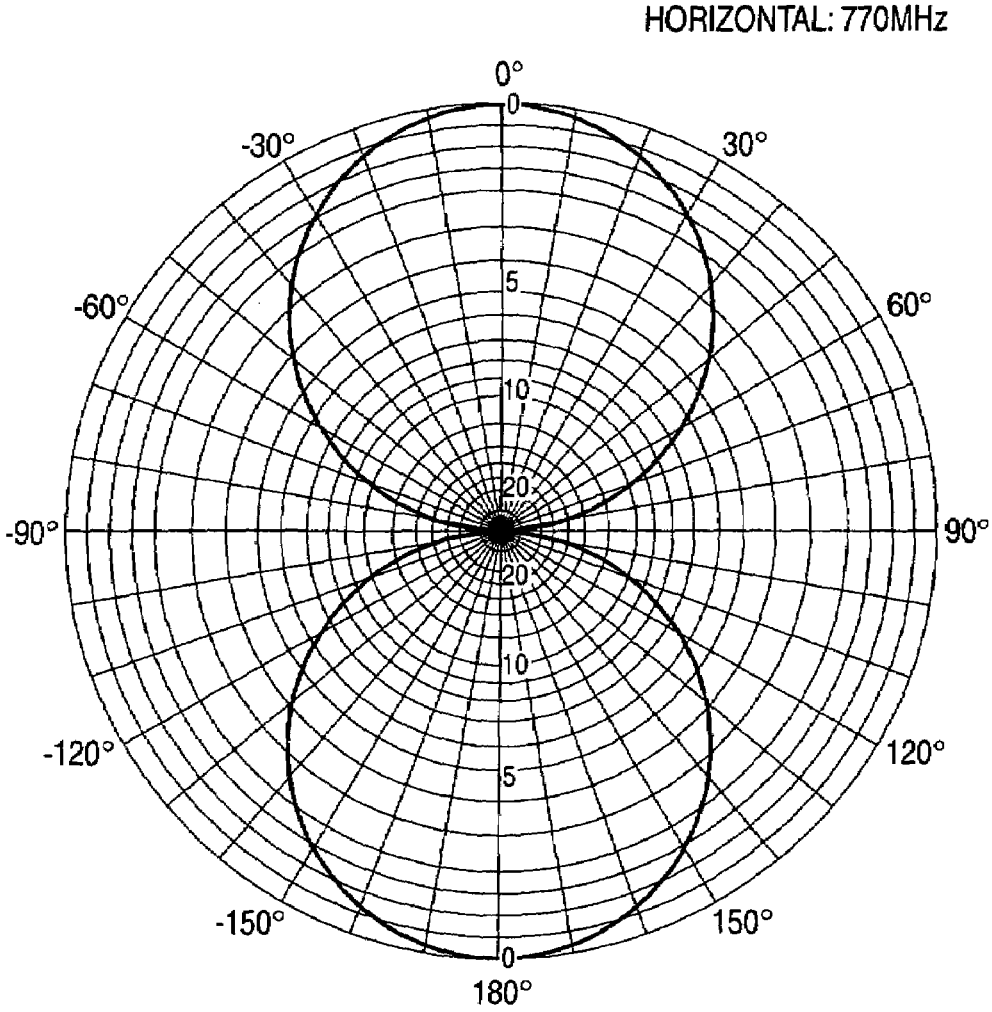
FIG. 5 is a graph showing a horizontal polarization horizontal plane directivity of the antenna of FIG. 1A at the frequency of 770 MHz.

FIG. 4 shows a horizontal polarization horizontal plane directivity (polar coordinates in dB scale) at the frequency of 470 MHz of the antenna 10A, and FIG. 5 shows a horizontal polarization horizontal plane directivity (polar coordinates in dB scale) at the frequency of 770 MHz of the antenna 10A.

Figure 6:
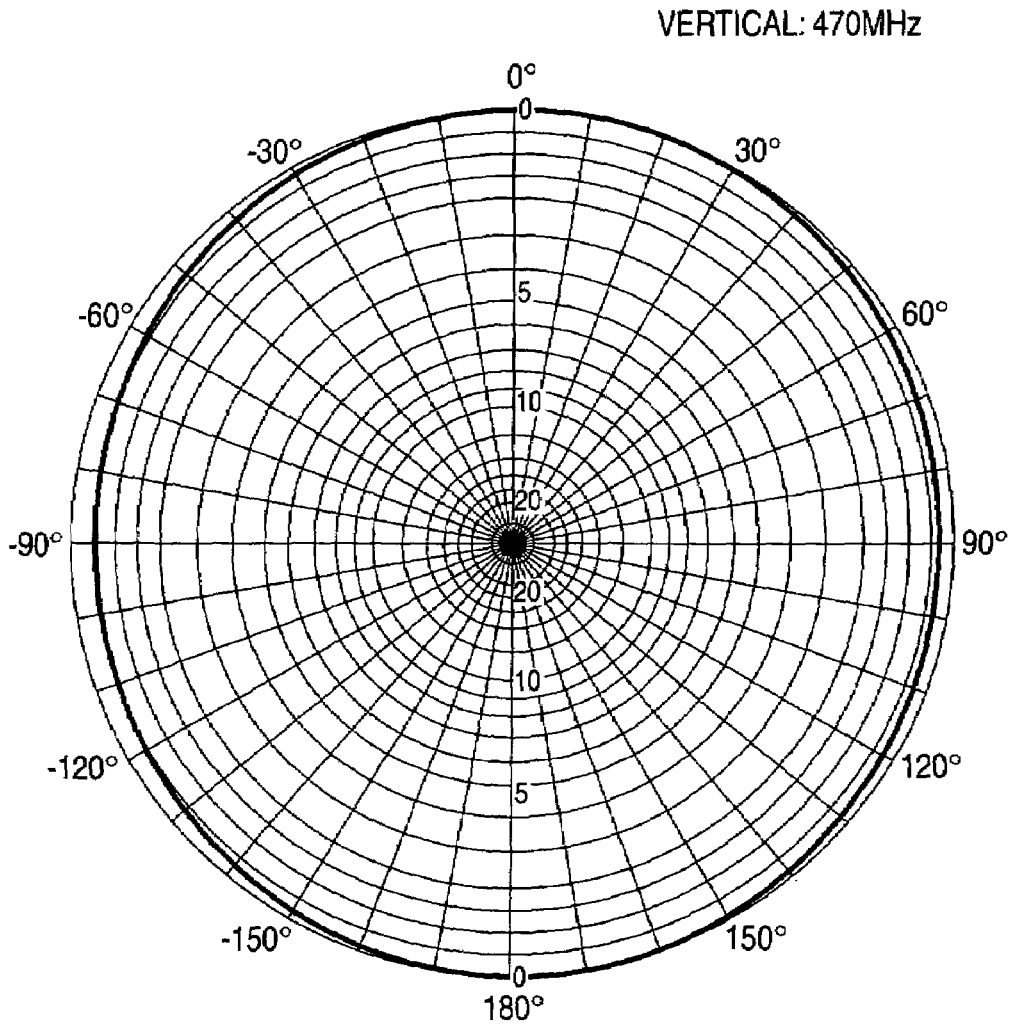
FIG. 6 is a graph showing a horizontal polarization vertical plane directivity of the antenna of FIG. 1A at the frequency of 470 MHz.
Figure 7:
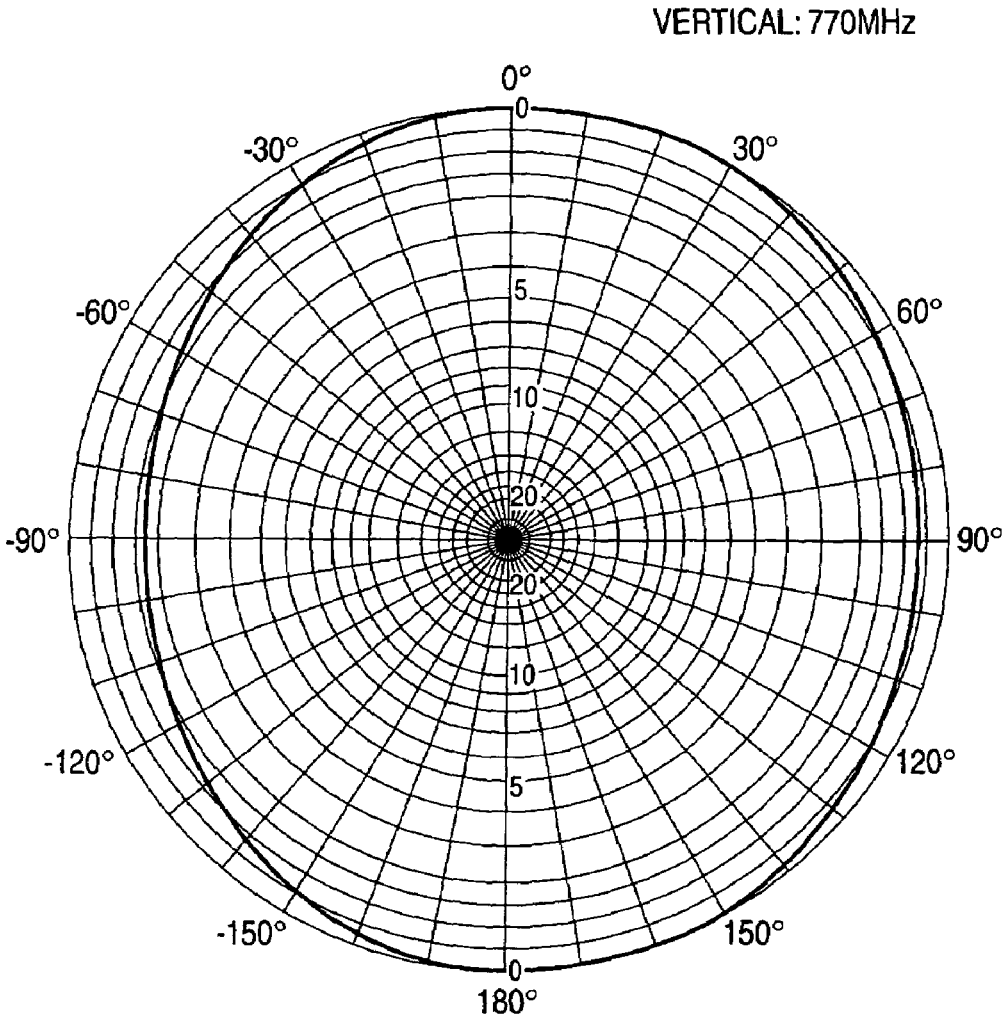
FIG. 7 is a graph showing a horizontal polarization vertical plane directivity of the antenna of FIG. 1A at the frequency of 770 MHz.

FIG. 6 shows a horizontal polarization vertical plane directivity (polar coordinate in dB scale) at the frequency of 470 MHz of the antenna 10A, and FIG. 7 shows a horizontal polarization vertical plane directivity (polar coordinates in dB scale) at the frequency of 770 MHz of the antenna 10A.

Since the phase of the electromagnetic wave radiated from the feeding side of the dipole elements 11*a*, 11*b* is different from the phase of the electromagnetic wave radiated from the non-feeding side in the antenna 10A, although the maximum value direction of the directivity (vertical plane) is originally tilted to the non-feeding side, it is possible to avoid that the maximum value direction of the directivity (vertical plane) of this antenna 10A is excessively tilted by employing such a way. That is, as indicated in the first embodiment, while the plate-shaped dipole elements 11*a*, 11*b* are employed, or such dipole elements 11*a*, 11*b* are provided in which the holes 20*a*, 20*b* have been formed in the center portions thereof, the amplitude of the electromagnetic wave radiated from the feeding side, and the like, are balanced with the amplitude of the electromagnetic wave radiated from the feeding side. For example, at the frequency of 470 MHz, the maximum value direction of the directivity (vertical plane) can be suppressed to such a tilt of an azimuth angle of approximately 7.3 degrees, and also, at the frequency of 770 MHz, the maximum value direction of the directivity (vertical plane) can be suppressed to such a tilt of an azimuth angle of approximately 13.9 degrees.

In this embodiment, the entire length "L" of the dipole elements 11*a*, 11*b* can be made short, namely approximately 0.35 λa, so that the antenna 10A can be made compact, as compared with the conventional UHF antenna. Also, since either the plate-shaped dipole elements 11*a*, 11*b* or such dipole elements 11*a*, 11*b* that the holes 20*a*, 20*b* have been formed in the center portion thereof are held by the retainer 12, a total number of antenna components is equal to three, and also, the shape of the antenna 10A is very simple. Therefore, this antenna 10A can be manufactured in a very easy manner and in low cost without requiring a punching die, a bending die, and so on. Furthermore, these dipole elements 11*a*, 11*b* can be constituted by employing various sorts of conductor materials, for instance, aluminum having merits of low cost and superior durability, brass materials capable of being soldered, and stainless steel materials having superior strengths. Also, since a metal mold is used, various sorts of shapes as to the dipole elements 11*a*, 11*b* may be formed.

Figure 8A:
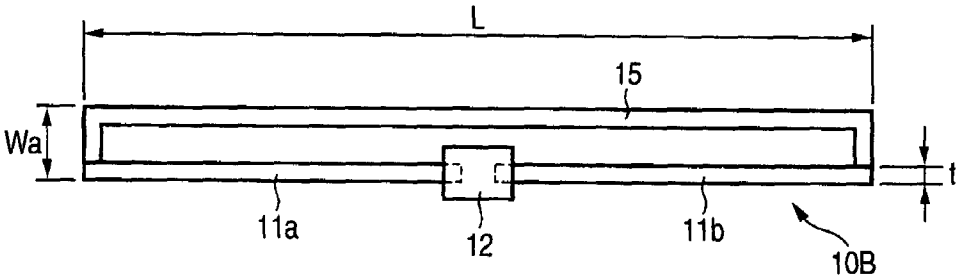
FIG. 8A is a top view of an antenna according to a second embodiment of the invention.
Figure 8B:
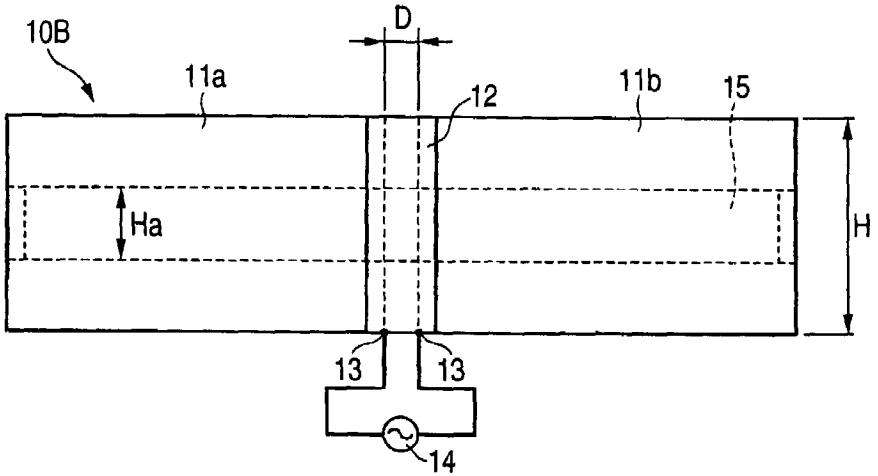
FIG. 8B is a front view of the antenna of FIG. 8A.
Figure 8C:
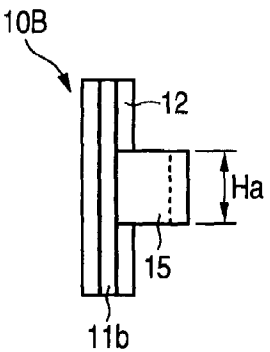
FIG. 8C is a side view of the antenna of FIG. 8A.

FIGS. 8A to 8C show a UHF broadband antenna 10B according to a second embodiment of the present invention.

In this embodiment, a folded element 15 which has been manufactured by a metal plate is provided on rear face sides of dipole elements 11*a*, 11*b* which are held by a retainer 12. In this case, the folded element 15 is provided in such a manner that this folded element 15 is located along, for example, a substantially center on the rear face sides of the dipole elements 11*a*, 11*b*. It should also be noted that the same reference numerals shown in the first embodiment will be employed as those for denoting the same structural elements of the second embodiment, and detailed explanations thereof are omitted.

A thickness of the above-described folded element 15 is set to be the same to 0.0015 λa as that of the dipole elements 11*a*, 11*b*; and a height "Ha" is set to be higher than, or equal to 0.0015 λa, namely lower than the height "H" of the dipole elements 11*a*, 11*b*. Also, a folded width "Wa" of the folded element 15 is set to approximately 0.05 λa.

In order to connect the above-described dipole elements 11*a*, 11*b* to the folded element 15, arbitrary connecting means such as soldering and screwing may be employed. Alternatively, both the dipole elements 11*a*, 11*b* may be integrally formed with the folded element 15.

As previously explained, since the folded element 15 is provided with respect to the dipole elements 11*a*, 11*b*, the dipole elements 11*a*, 11*b* may be operated as folded dipoles having different thicknesses due to the effect of the folded element 15, and may be operated in a further broad band. Also, since the step up effect of the impedance is obtained which is the feature of the folded dipoles having the different widthnesses, the antenna 10B can be directly connected to such a signal line having a characteristic impedance of 75 Ω without an impedance conversion, so that a gain of this antenna 10B can be increased by 0.5 to 1.0 dB without any impedance conversion loss.

Figure 9C:
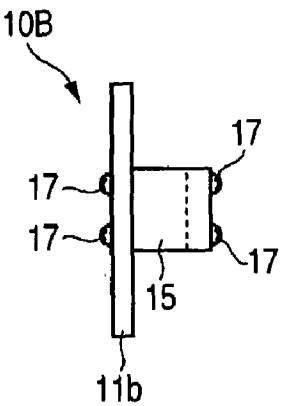
FIG. 9C is a side view of the antenna of FIG. 9A.
Figure 9A:
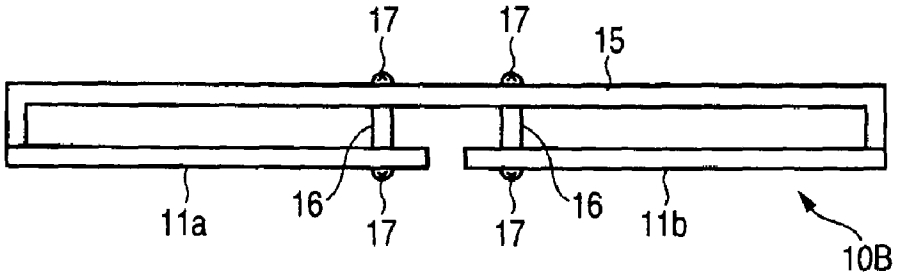
FIG. 9A is a top view of an antenna according to a modified example of the antenna of FIG. 8A.
Figure 9B:
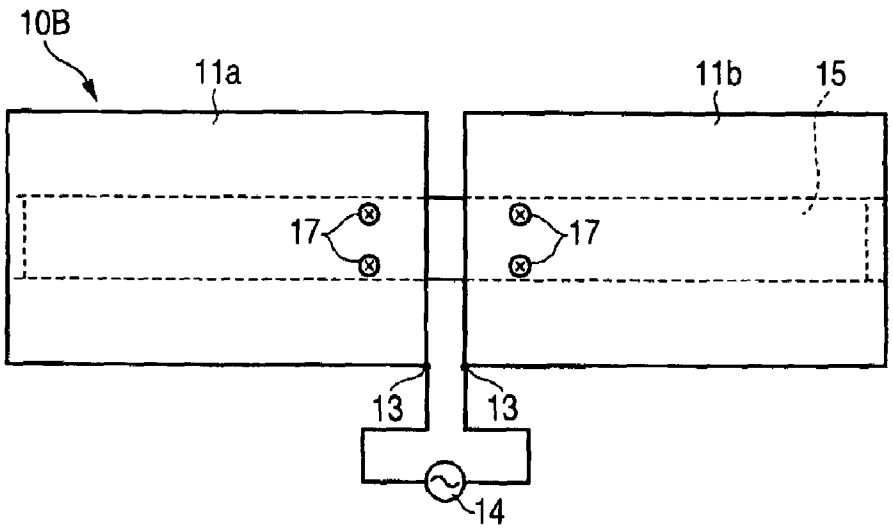
FIG. 9B is a front view of the antenna of FIG. 9A.

Instead of the retainer 12, other means may be alternatively employed so as to hold the dipole elements 11*a*, 11*b*. For instance, as shown in FIGS. 9A to 9C, a plurality of cylindrical retainers 16 made of an insulative material may be alternatively interposed between each of the dipole elements 11*a*, 11*b* and the folded element 15, and the dipole elements 11*a*, 11*b* and the folded element 15 are fixed by screws 17 via the retainers 16.

Here, holes 20*a*, 20*b* may be provided in the center portions of the dipole elements 11*a*, 11*b* as shown in FIGS. 2A to 2C Even in such a case, a similar effect of the case that the plate-shape dipole elements 11*a*, 11*b* shown in FIGS. 8A through 9C are employed can be achieved.

Figure 10:
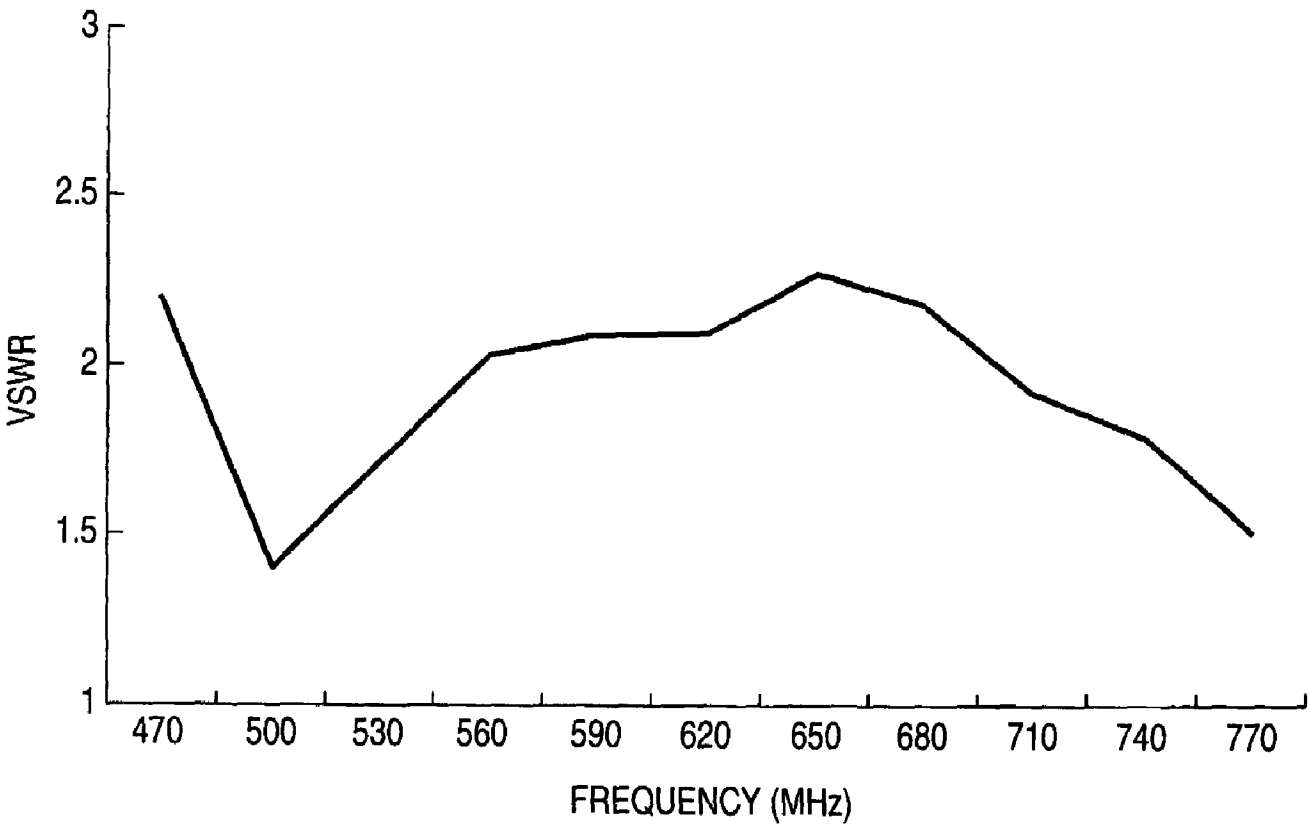
FIG. 10 is a graph showing a voltage standing-wave ratio characteristic of the antenna of FIG. 8A.

FIG. 10 shows a VSWR characteristic of the antenna 10B, wherein the entire length "L" of the dipole elements 11*a*, 11*b* is set to 0.35 λa; the height "H" thereof is set to 0.1 λa; the thickness "t" thereof is set to 0.0015 λa; the interval "D" thereof is set to 0.0018 λa; a height "h" of the folded element 15 is set to 0.0015 λa; a folded width "Wa" of the folded element 15 is set to 0.05 λa; and also, the UHF frequency band thereof is set from 470 MHz to 770 MHz; an abscissa of this VSWR characteristic indicates a frequency (MHz), whereas an ordinate thereof indicates a VSWR (voltage standing-wave ratio). This VSWR characteristic shows a superior characteristic over the UHF frequency band defined from 470 MHz to 770 MHz.

Figure 11:
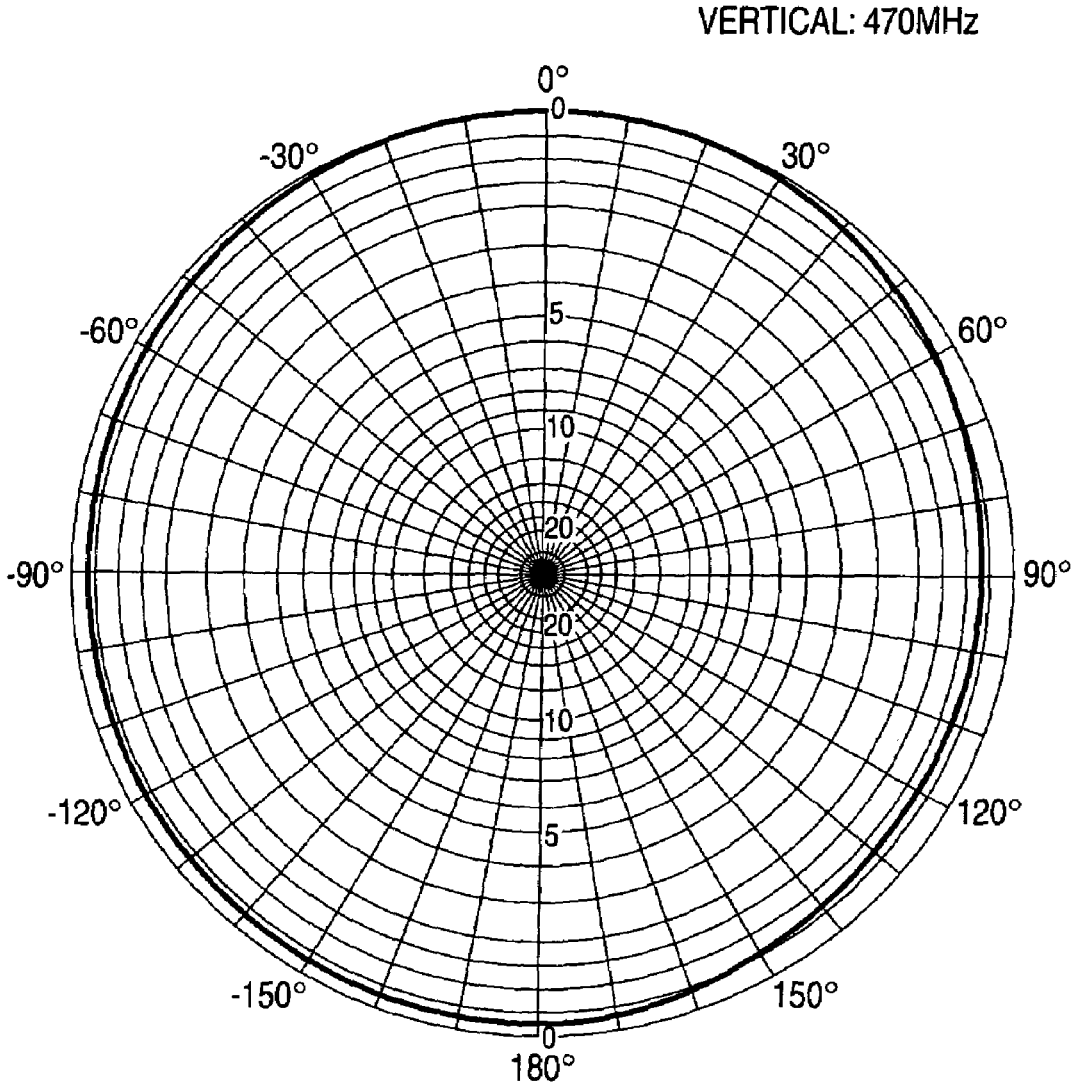
FIG. 11 is a graph showing a horizontal polarization vertical plane directivity of the antenna of FIG. 8A at the frequency of 470 MHz.
Figure 12:
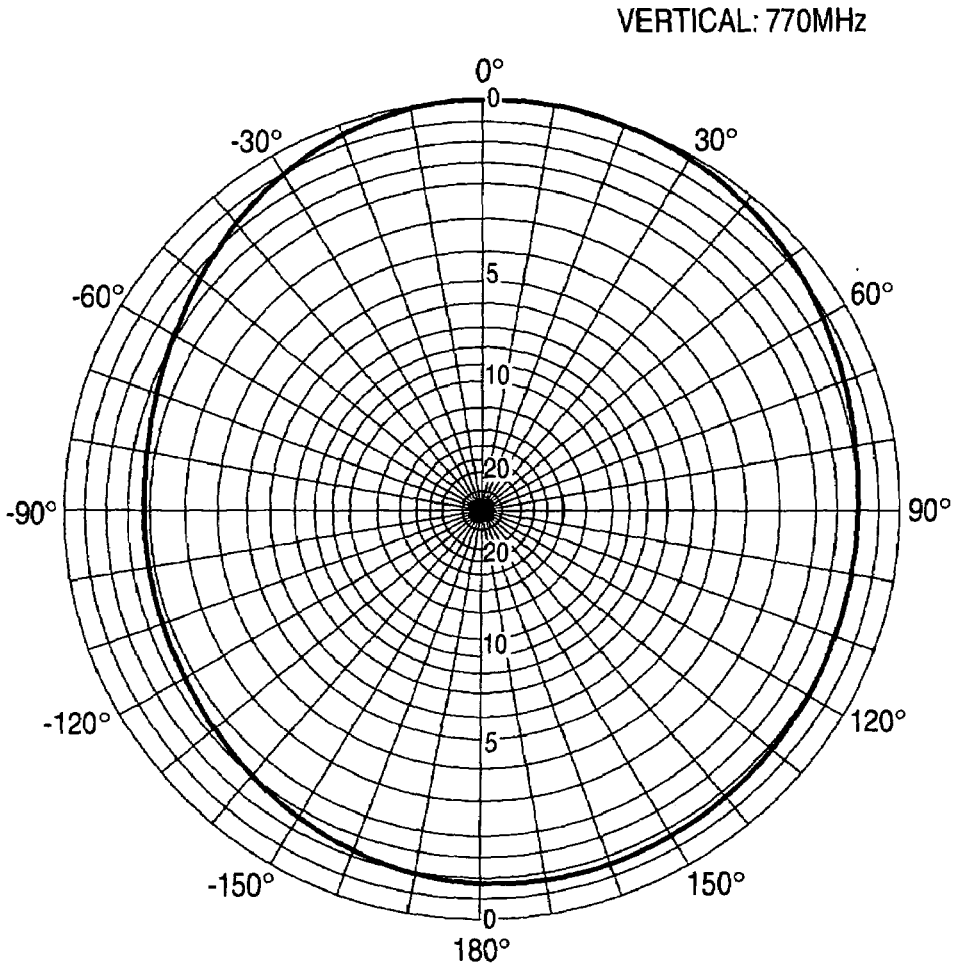
FIG. 12 is a graph showing a horizontal polarization vertical plane directivity of the antenna of FIG. 8A at the frequency of 770 MHz.

Also, FIG. 11 shows a horizontal polarization vertical plane directivity (polar coordinate in dB scale) at the frequency of 470 MHz of the antenna 10B, which has been set under the same condition of FIG. 10; and FIG. 12 shows a horizontal polarization vertical plane directivity (polar coordinates in dB scale) at the frequency of 770 MHz of this antenna 10B.

Also in this embodiment, it is possible to avoid that the maximum value direction of the directivity (vertical plane) is excessively tilted. For instance, as indicated in FIG. 11, the maximum value direction of the directivity (vertical plane) can be suppressed to such a tilt of an azimuth angle of 0 degrees at the frequency of 470 MHz, and also, the maximum value direction of the directivity (vertical plane) can be suppressed to such a tilt of an azimuth angle of approximately 10.4 degrees at the frequency of 770 MHz. This second embodiment can further improve the tilt aspect, as compared with that of the first embodiment.

Figure 13A:
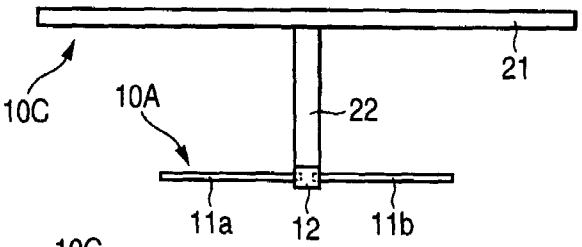
FIG. 13A is a top view of an antenna according to a third embodiment of the invention.
Figure 13B:
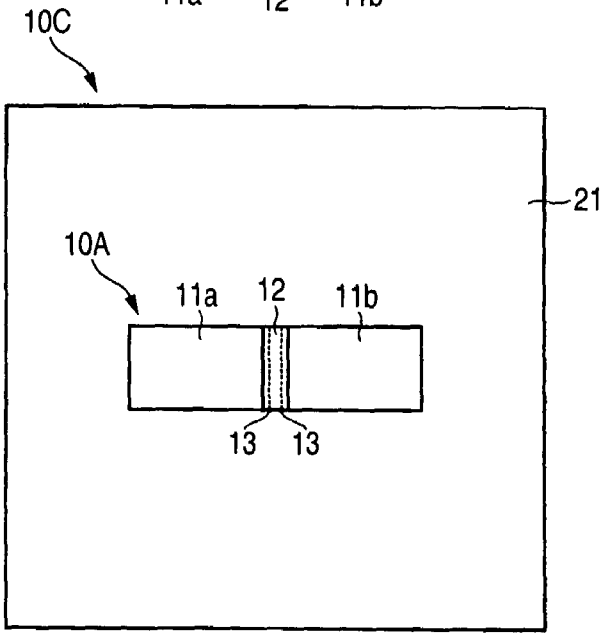
FIG. 13B is a front view of the antenna of FIG. 13A.
Figure 13C:
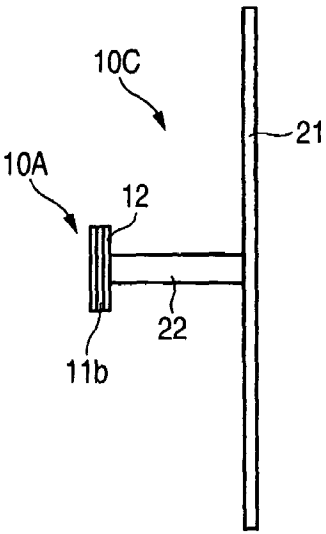
FIG. 13C is a side view of the antenna of FIG. 13A.

FIGS. 13A to 13C show a UHF broadband antenna according to a third embodiment of the present invention.

In this embodiment, an antenna 10C having a reflecting plate is equipped with the UHF broadband antenna 10A according to the first embodiment as a driven element. In other words, a reflecting plate 21 is provided behind the antenna 10A of the first embodiment with a predetermined interval, and the retainer 12 of the antenna 10A is supported via a supporting pillar 22 at a center portion of this reflecting plate 21. The above-explained reflecting plate 21 is formed in a shape of, for example, a rectangular shape, and owns a sufficiently large area relative to the antenna 10A.

With this configuration, a gain thereof along the forward direction can be further increased and high performance thereof can be obtained, as compared in those of the antenna 10A of the first embodiment.

Also, since the antenna 10A is capable of avoiding that the maximum value direction of the directivity (vertical plane) is excessively tilted, even in such an antenna 10C equipped with the reflecting plate while this antenna 10A is employed as the driven element, it is possible to avoid that the maximum value direction of the directivity (vertical plane) is excessively tilted similar to that of the first embodiment.

Figure 14A:
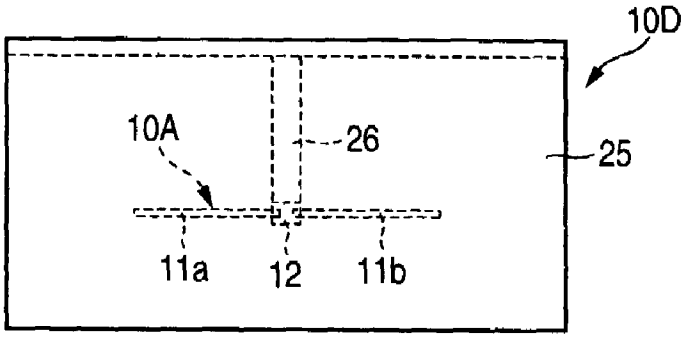
FIG. 14A is a top view of an antenna according to a fourth embodiment of the invention.
Figure 14B:
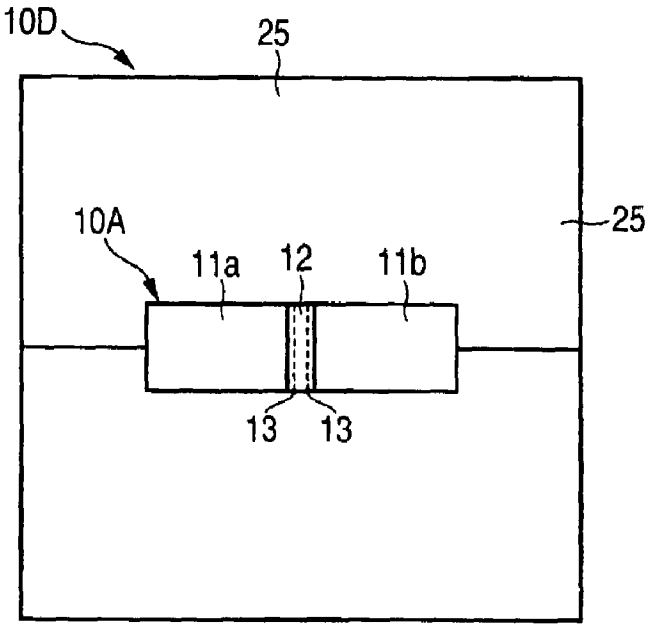
FIG. 14B is a front view of the antenna of FIG. 14A.
Figure 14C:
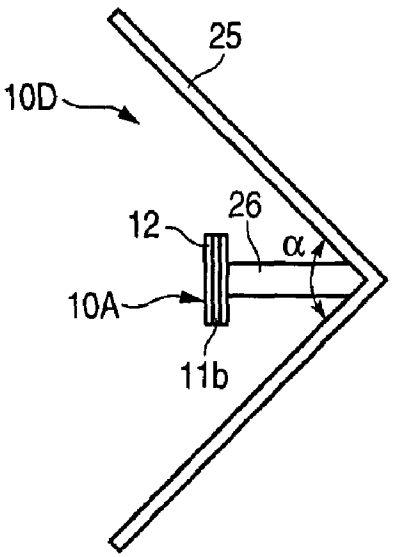
FIG. 14C is a side view of the antenna of FIG. 14A.

FIGS. 14A to 14C show a UHF broadband antenna according to a fourth embodiment of the present invention.

In this embodiment, there is provided a corner reflector antenna 10D equipped with the UHF broadband antenna 10A of the first embodiment as a driven element. In other words, a corner reflector 25 is provided behind the antenna 10A with a predetermined interval, and the retainer 12 of the antenna 10A is supported via a supporting pillar 26 at a center portion of this corner reflector 25.

With this configuration, a gain thereof along the forward direction can be further increased and high performance thereof can be obtained, as compared with those of the antenna 10A of the first embodiment. Also, the directivity within the horizontal plane can be controlled by changing an angle "a" of the corner reflector 25.

Figure 15A:
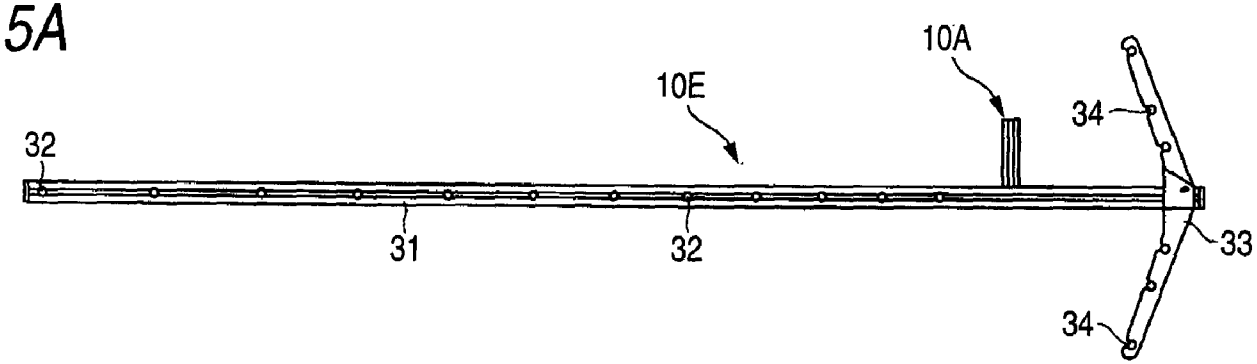
FIG. 15A is a side view of an antenna according to a fifth embodiment of the invention.
Figure 15B:
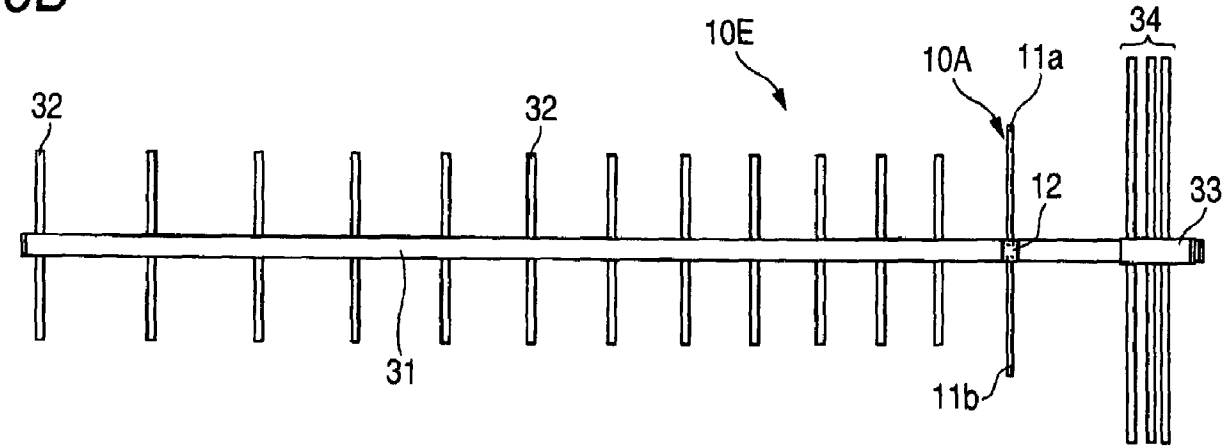
FIG. 15B is a top view of the antenna of FIG. 15A.

FIGS. 15A and 15B show a UHF broadband antenna according to a fifth embodiment of the present invention.

In this embodiment, there is provided a YAGI type antenna 10E equipped with the UHF broadband antenna 10A of the first embodiment as a driven element.

That is to say, while the antenna 10A of the first embodiment is provided on a boom 31 of the YAGI type antenna 10E, a plurality of waveguides 32 are arranged in front of this driven element at a predetermined interval. Also, while a reflecting arm 33 is mounted on this boom 31 behind the antenna 10A with a predetermined interval, a plurality of reflection elements 34 are provided on this reflecting arm 33 by keeping a predetermined interval along upper and lower directions.

Since the antenna 10A of the first embodiment is used as the driven element of the YAGI type antenna 10E, higher performance of this YAGI type antenna 10E can be realized, as compared with that of the conventional YAGI type antenna due to the effect of the gain improvement owned by the driven element itself.

Figure 16A:
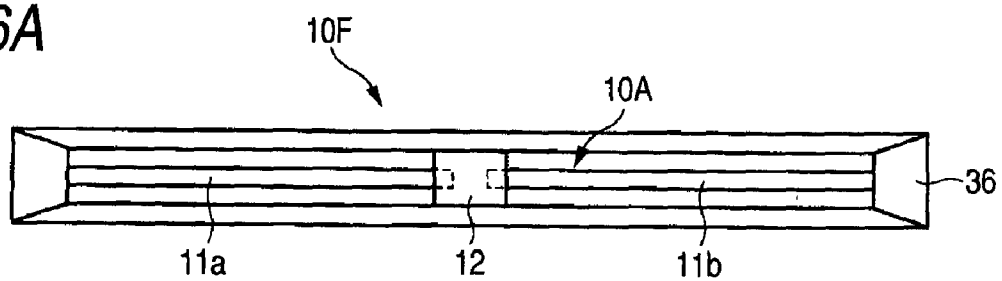
FIG. 16A is a top view of an antenna according to a sixth embodiment of the invention.
Figure 16B:
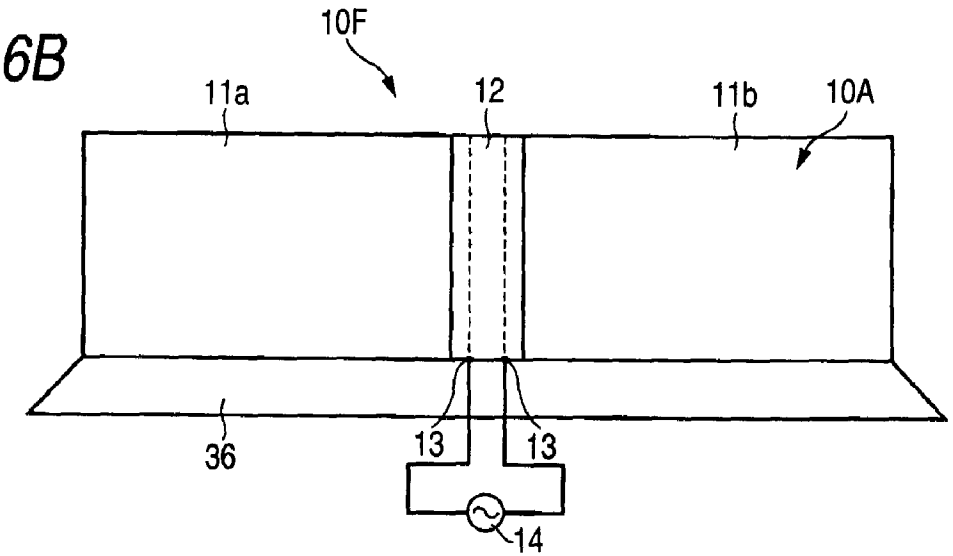
FIG. 16B is a front view of the antenna of FIG. 16A.
Figure 16C:
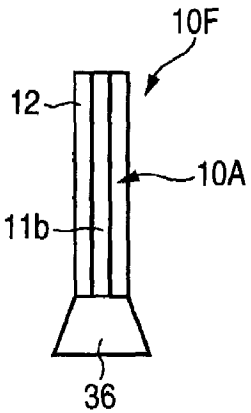
FIG. 16C is a side view of the antenna of FIG. 16A.

FIGS. 16A to 16C show a UHF broadband antenna according to a sixth embodiment of the present invention.

In this embodiment, there is provided an indoor antenna 10F equipped with the UHF broadband antenna 10A of the first embodiment as a driven element.

In other words, the antenna 10A of the first embodiment is provided on a base 36 which is made of an insulative member.

Since the antenna 10A is used as the driven element, the indoor antenna 10F can be made compact, so that an installation space can be made small and high performance can be obtained.

Figure 17A:
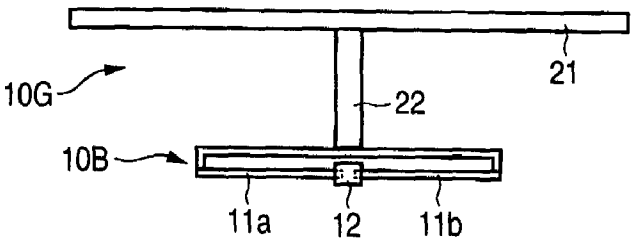
FIG. 17A is a top view of an antenna according to a seventh embodiment of the invention.
Figure 17B:
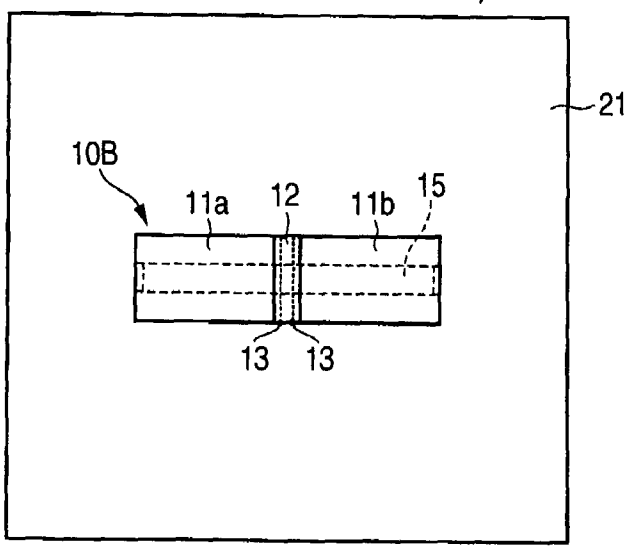
FIG. 17B is a front view of the antenna of FIG. 17A.
Figure 17C:
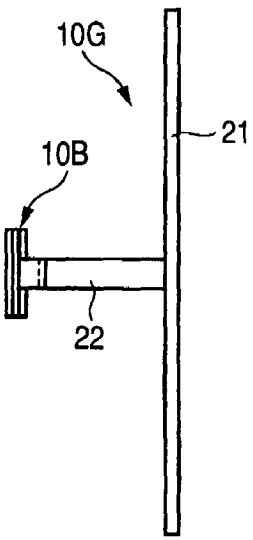
FIG. 17C is a side view of the antenna of FIG. 17A.

FIGS. 17A to 17C show a UHF broadband antenna according to a seventh embodiment of the present invention.

In this embodiment, an antenna 10G having a reflecting plate is equipped with the UHF broadband antenna 10B of the second embodiment as a driven element.

In other words, a reflecting plate 21 is provided behind the antenna 10B of the second embodiment with a predetermined interval, and the retainer 12 of the antenna 10B is supported via a supporting pillar 22 at a center portion of this reflecting plate 21. The above-explained reflecting plate 21 is formed in a shape of, for example, a rectangular shape, and owns a sufficiently large area relative to the antenna 10A.

With this configuration, a gain thereof along the forward direction can be further increased and high performance thereof can be obtained, as compared with those of the antenna 10B of the second embodiment.

Figure 18:
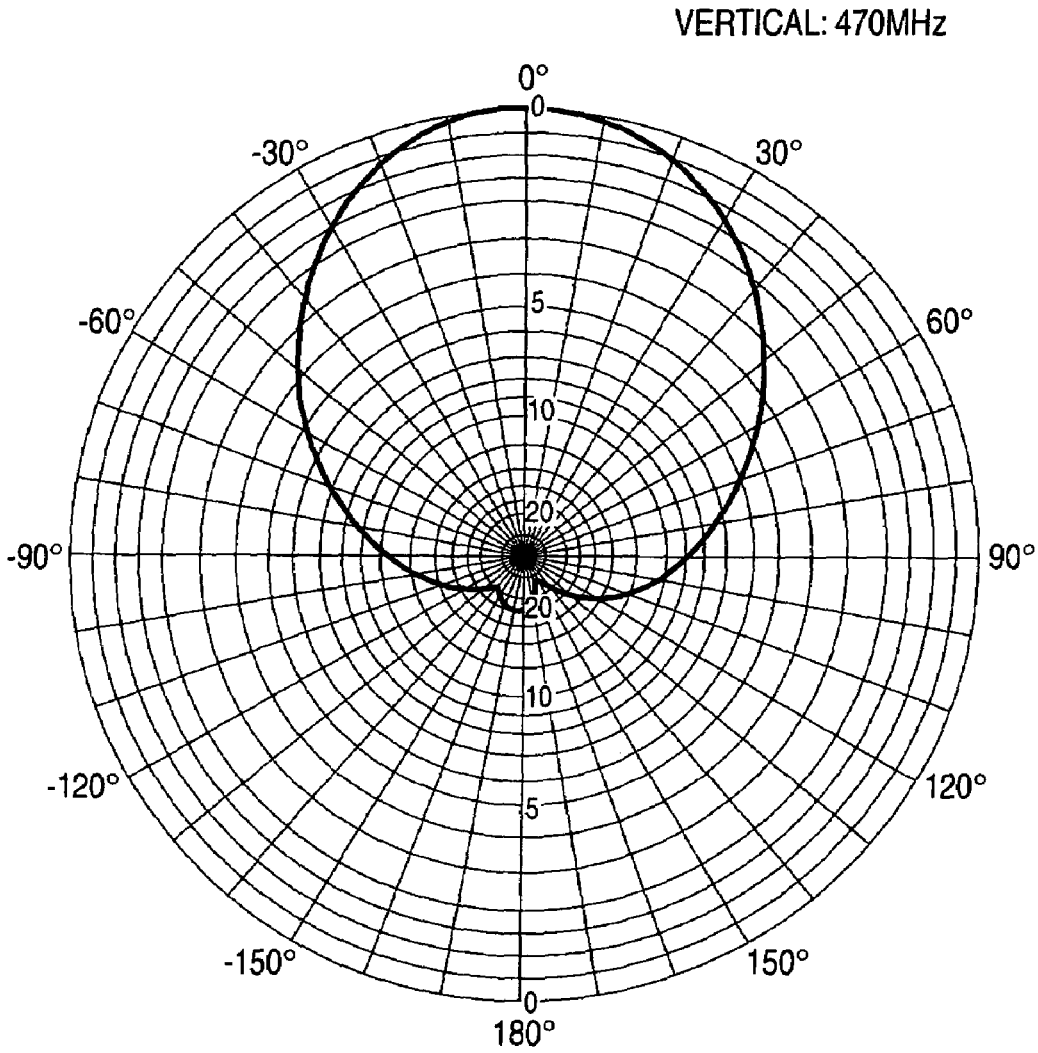
FIG. 18 is a graph showing a horizontal polarization vertical plane directivity of the antenna of FIG. 17A at the frequency of 470 MHz.
Figure 19:
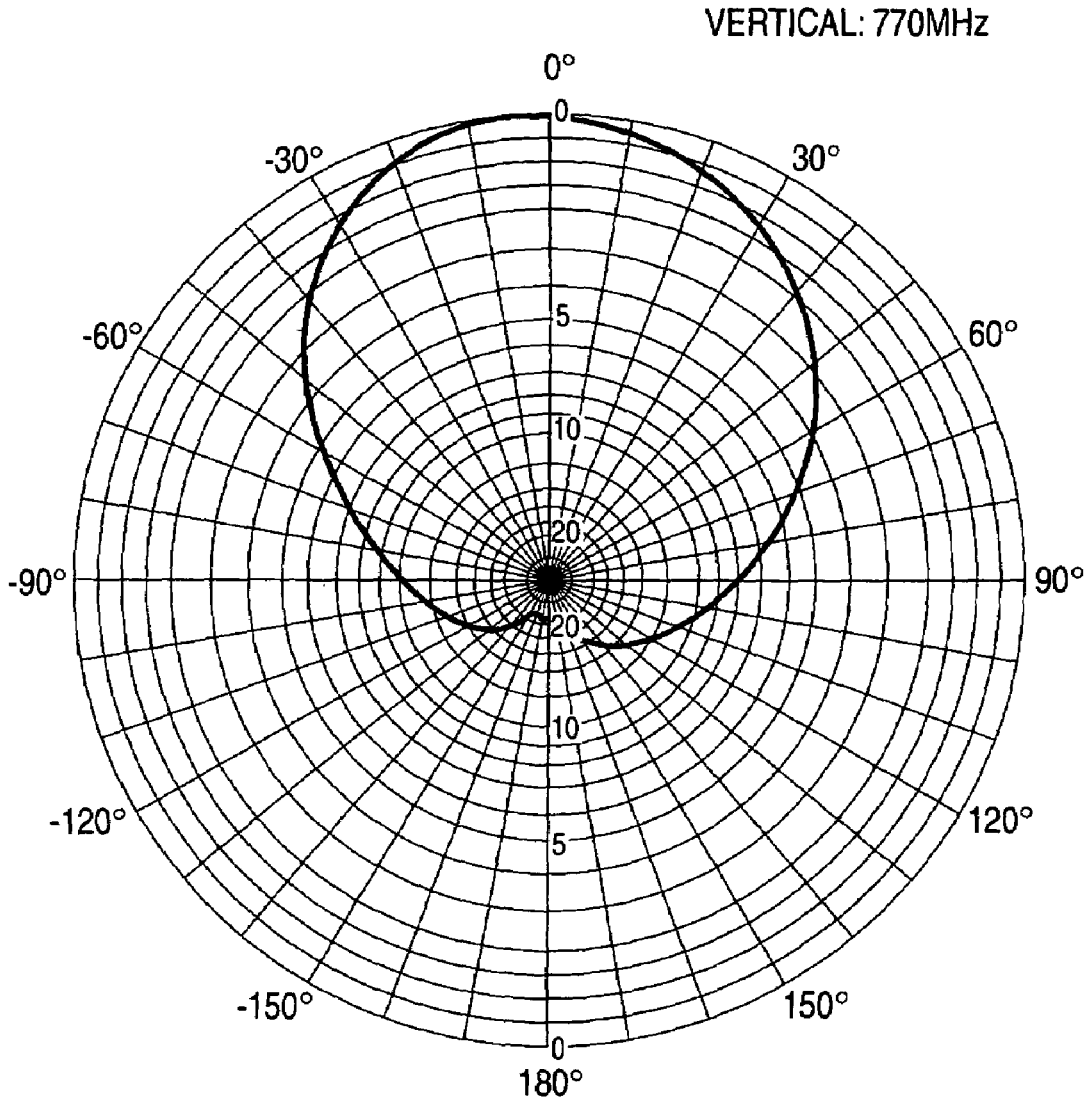
FIG. 19 is a graph showing a horizontal polarization vertical plane directivity of the antenna of FIG. 17A at the frequency of 770 MHz.

Also, as shown in FIGS. 18 and 19, it is possible to avoid that the maximum value direction of the directivity (vertical plane) is excessively tilted. FIG. 18 shows a horizontal polarization vertical plane directivity (polar coordinates in dB scale) of the antenna 10C equipped with the reflecting plate at the frequency of 470 MHz. FIG. 19 shows a horizontal polarization vertical plane directivity (polar coordinates in dB scale) of the antenna 10C equipped with the reflecting plate at the frequency of 770 MHz. Even in any one of these frequencies of 470 MHz and 770 MHz, the maximum value direction of the directivity (vertical plane) can be set to a direction of an azimuth angle of 0 degrees.

Figure 20C:
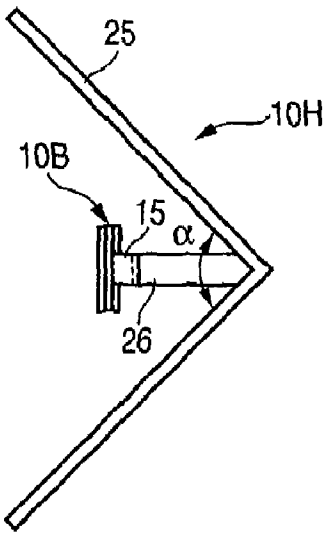
FIG. 20C is a side view of the antenna of FIG. 20A.
Figure 20A:
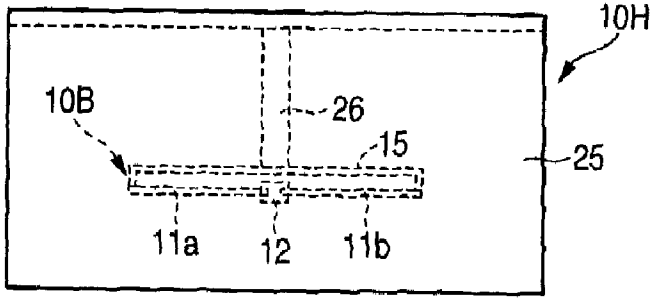
FIG. 20A is a top view of an antenna according to an eighth embodiment of the invention.
Figure 20B:
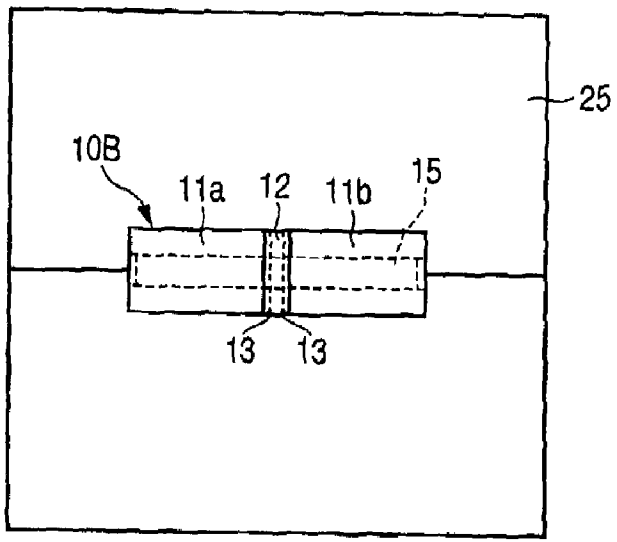
FIG. 20B is a front view of the antenna of FIG. 20A.

FIGS. 20A to 20C show a UHF broadband antenna according to an eighth embodiment of the present invention.

In this embodiment, there is provided with a corner reflector antenna 10H equipped with the UHF broadband antenna 10B of the second embodiment as a driven element. In other words, a corner reflector 25 is provided behind the antenna 10B of the second embodiment with a predetermined interval, and the retainer 12 of the antenna 10B is supported via a supporting pillar 26 at a center portion of this corner reflector 25.

With this configuration, a gain thereof along the forward direction can be further increased and high performance thereof can be obtained, as compared with those of the antenna 10B of the second embodiment. Also, the directivity within the horizontal plane can be controlled by changing an angle "a" of the corner reflector 25.

Figure 21A:
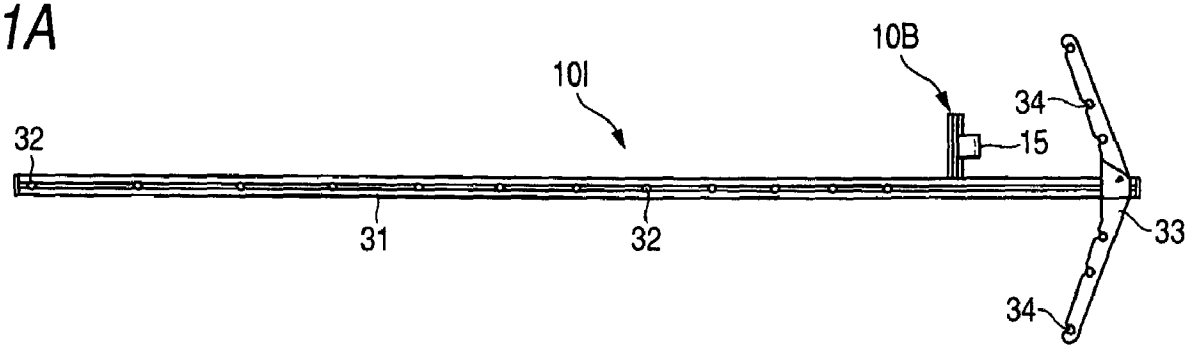
FIG. 21A is a side view of an antenna according to a ninth embodiment of the invention.
Figure 21B:
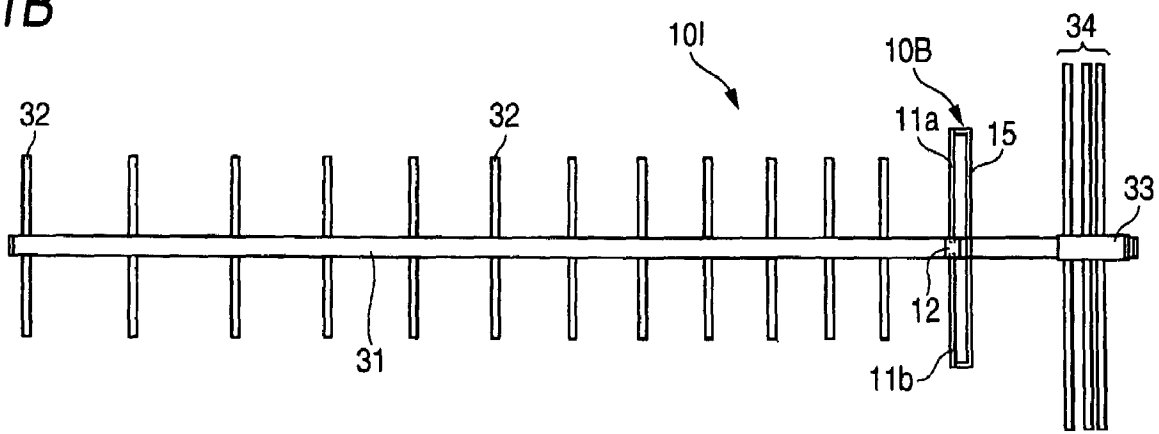
FIG. 21B is a top view of the antenna of FIG. 21A.

FIGS. 21A and 21B show a UHF broadband antenna according to a ninth embodiment of the present invention.

In this embodiment, there is provided a YAGI type antenna 10I equipped with the UHF broadband antenna 10B of the second embodiment as a driven element.

That is to say, while the antenna 10B of the second embodiment is provided on a boom 31 of the YAGI type antenna 10I, a plurality of waveguides 32 are arranged in front of this driven element at a predetermined interval. Also, while a reflecting arm 33 is mounted on this boom 31 behind the antenna 10B with a predetermined interval, a plurality of reflecting elements 34 are provided on this reflecting arm 33 by keeping a predetermined interval along upper and lower directions.

Since the antenna 10B of the second embodiment is used as the driven element of the YAGI type antenna 10E, higher performance of this YAGI type antenna 10I can be realized, as compared with that of the conventional YAGI type antenna due to the effect of the gain improvement owned by the driven element itself.

Figure 22A:
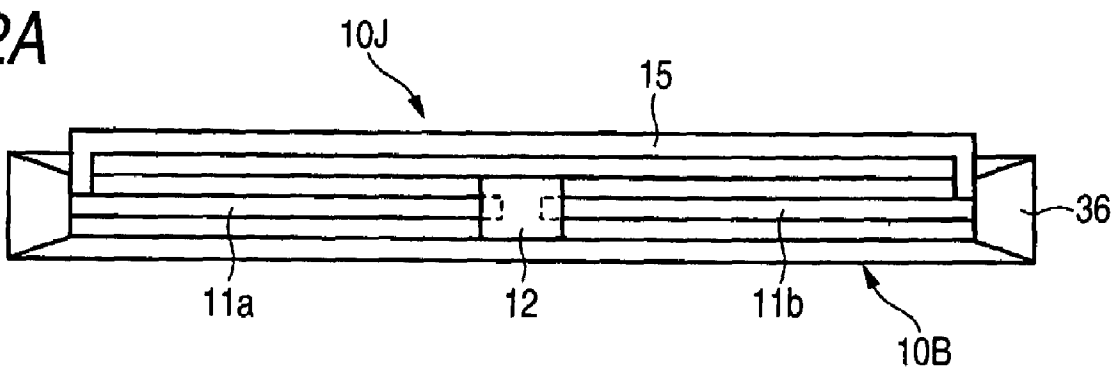
FIG. 22A is a top view of an antenna according to a tenth embodiment of the invention.
Figure 22B:
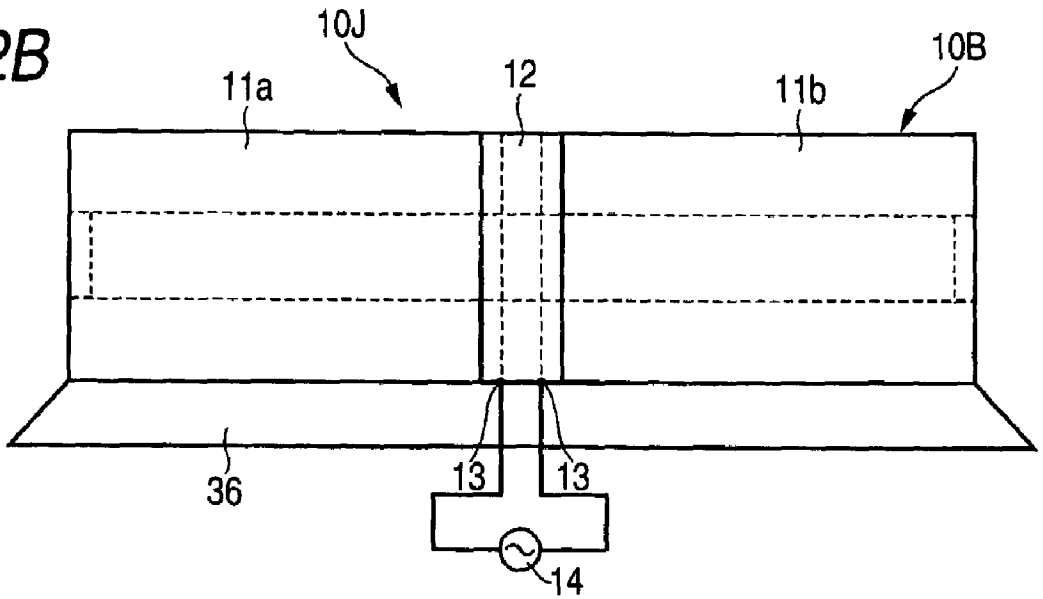
FIG. 22B is a front view of the antenna of FIG. 22A.
Figure 22C:
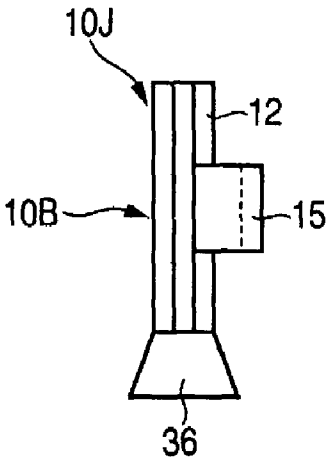
FIG. 22C is a side view of the antenna of FIG. 22A.

FIGS. 22A to 22C show a UHF broadband antenna according to a tenth embodiment of the present invention.

In this embodiment, there is provided an indoor antenna 10J equipped with the UHF broadband antenna 10B of the second embodiment as a driven element.

In other hands, the antenna 10B of the second embodiment is provided on a base 36 which is made of an insulative member.

Since the antenna 10B of the second embodiment is used as the driven element, the indoor antenna 10J can be made compact, so that an installation space can be made small and high performance can be obtained.

Figures 23A, 23B, 23C:
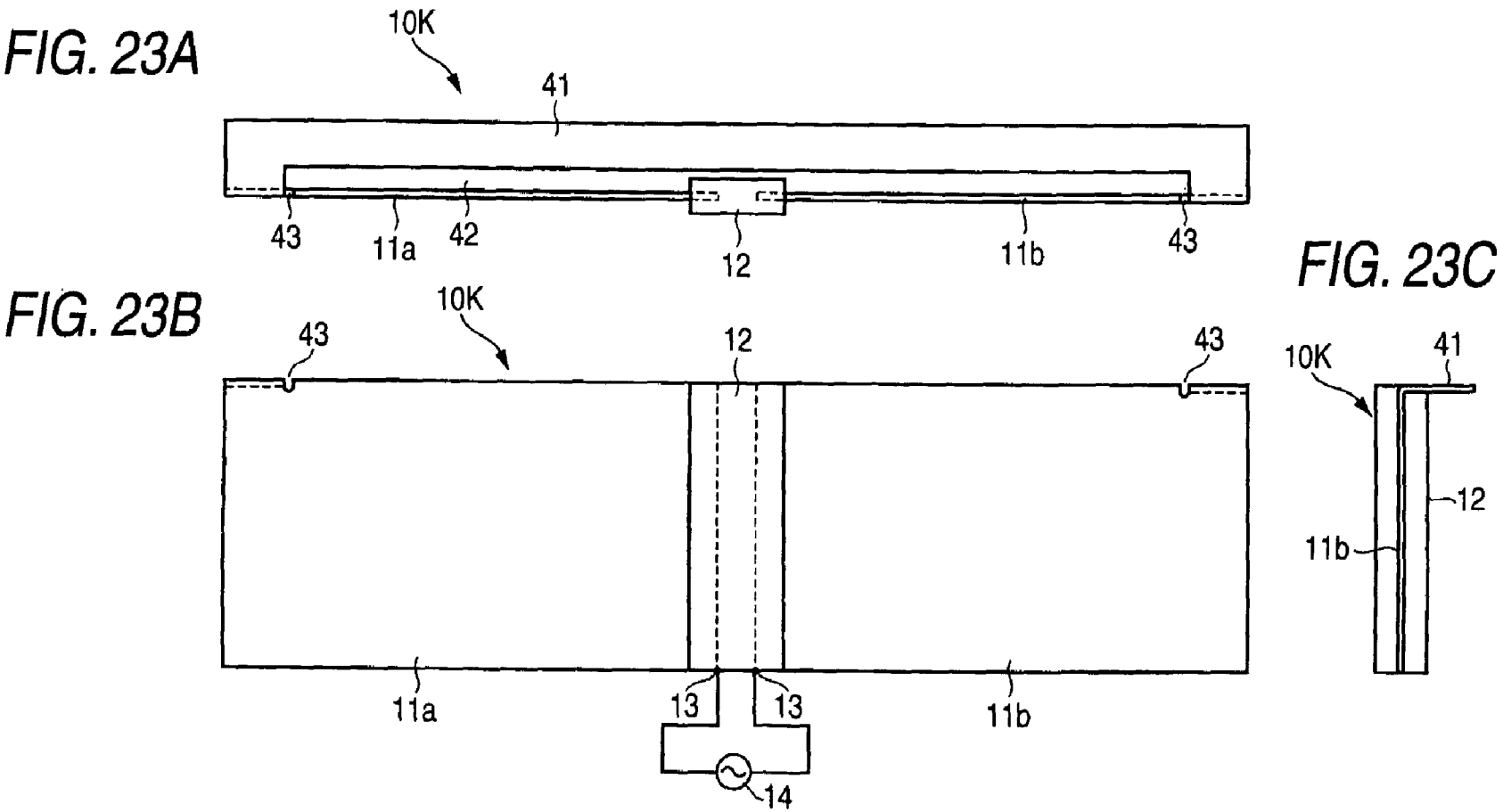
FIG. 23A is a top view of an antenna according to an eleventh embodiment of the invention.
FIG. 23B is a front view of the antenna of FIG. 23A.
FIG. 23C is a side view of the antenna of FIG. 23A.

FIGS. 23A to 23C show a UHF broadband antenna 10K according to an eleventh embodiment of the present invention.

In this embodiment a folded dipole antenna is constituted by bending upper ends of the dipole elements 11*a*, 11*b* of the UHF broadband antenna 10A of the first embodiment rearward to form a folded element 41.

The folded element 41 is connected to the dipole elements 11*a*, 11*b* at both end portions thereof, and a gap 42 having a predetermined width is provided between the dipole elements 11*a*, 11*b* at an intermediate portion thereof. Also, grooves 43 are formed in the vicinity of both end portions of the dipole elements 11*a*, 11*b*. When the folded element 41 is bent, these grooves 43 can cause this bending process to be easily carried out. Since other structures are similar to those of the antenna 10A of the first embodiment, detailed explanations thereof are omitted. It should be noted that the dipole elements 11*a*, 11*b* may be alternatively formed with the holes 20*a*, 20*b* as shown in FIGS. 2A to 2C.

With this configuration, a similar effect to that of the antenna 10B (namely, folded dipole antenna) of the second embodiment, and further, such a merit that the machining treatment can be further facilitated.

Figure 24A:
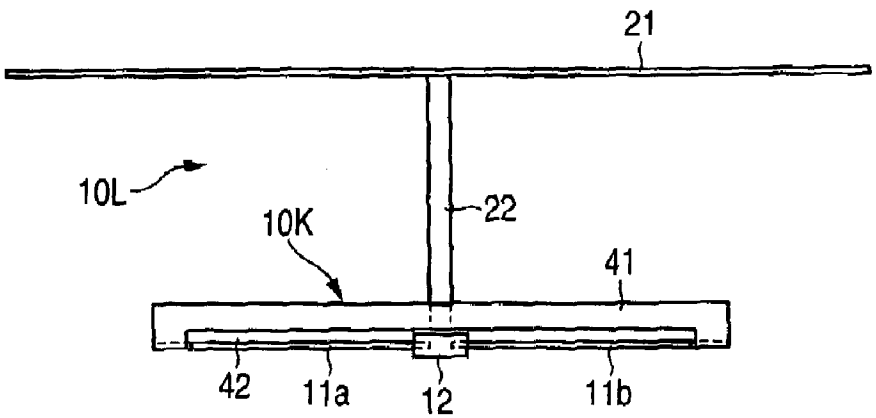
FIG. 24A is a top view of an antenna according to a twelfth embodiment of the invention.
Figure 24B:
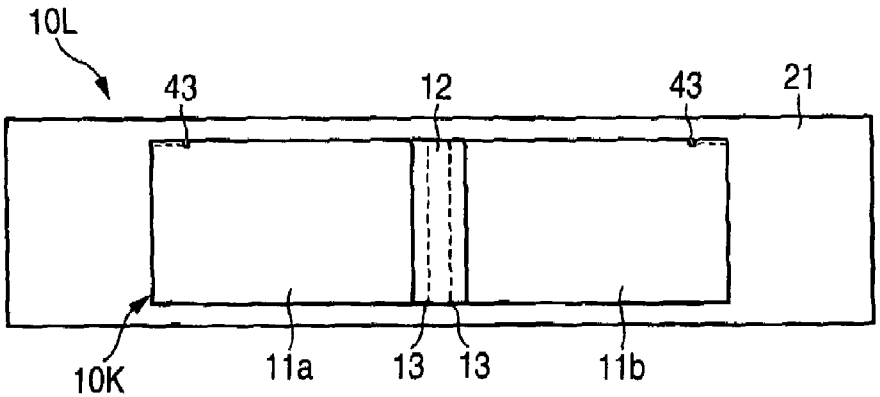
FIG. 24B is a front view of the antenna of FIG. 24A.
Figure 24C:
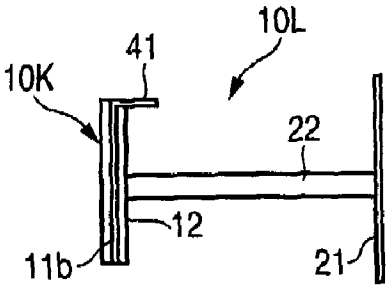
FIG. 24C is a side view of the antenna of FIG. 24A.

FIGS. 24A to 24C show a UHF broadband antenna according to a twelfth embodiment of the present invention.

In this embodiment, an antenna 10L having a reflecting plate is equipped with the UHF broadband antenna 10K of the eleventh embodiment as a driven element.

In other words, a reflecting plate 21 is provided behind the antenna 10K of the eleventh embodiment with a predetermined interval, and the retainer 12 of the antenna 10B is supported via a supporting pillar 22 at a center portion of this reflecting plate 21.

Figure 25:
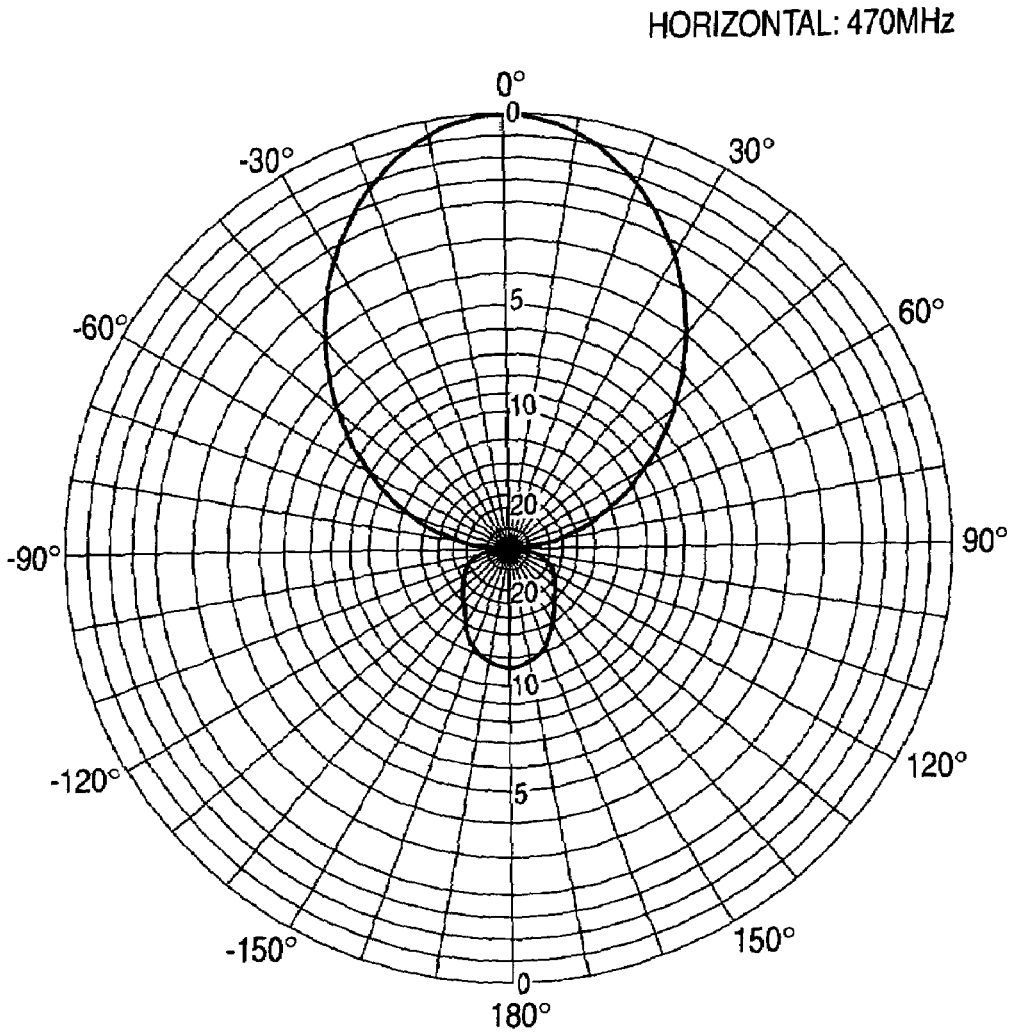
FIG. 25 is a graph showing a horizontal polarization vertical plane directivity of the antenna of FIG. 24A at the frequency of 470 MHz.
Figure 26:
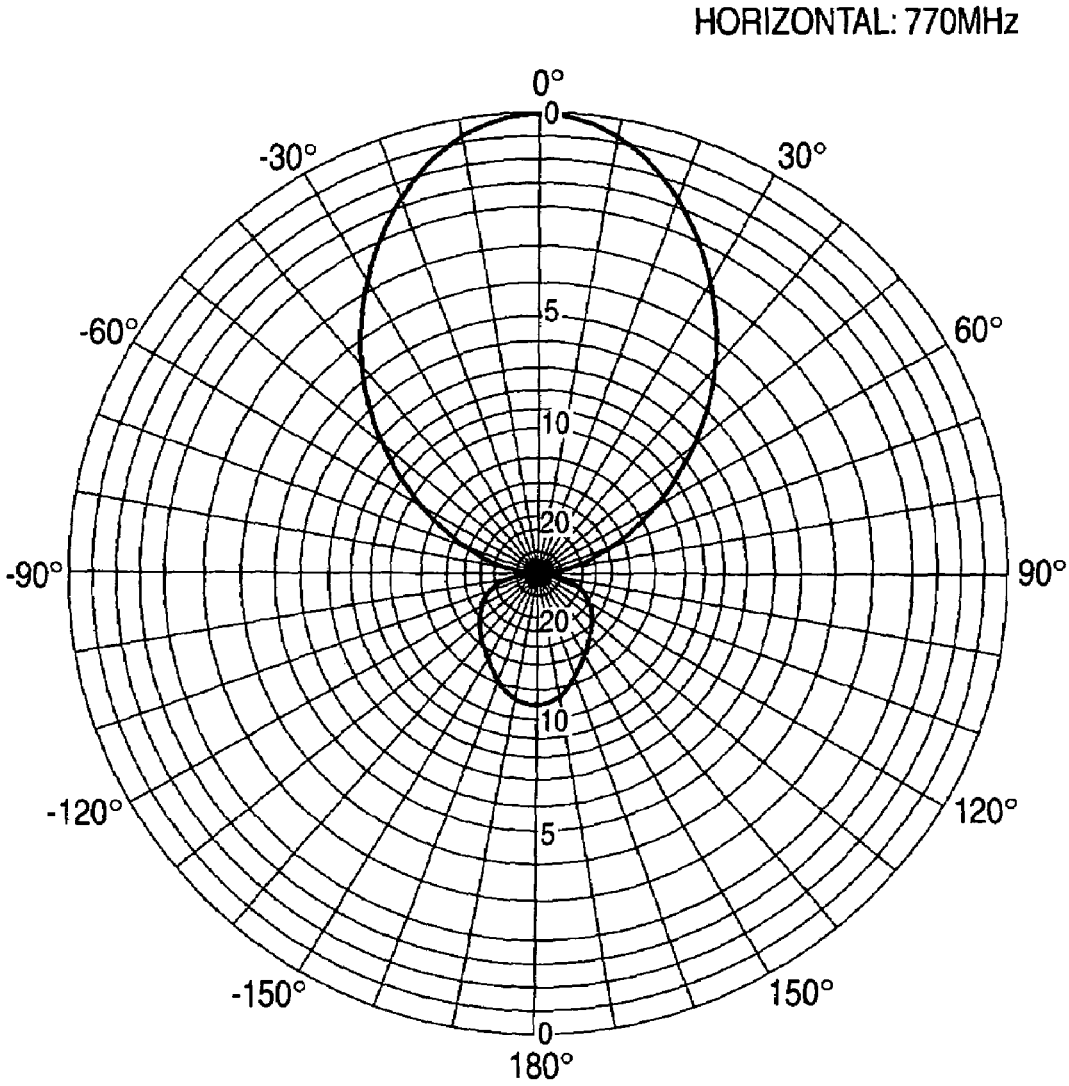
FIG. 26 is a graph showing a horizontal polarization vertical plane directivity of the antenna of FIG. 24A at the frequency of 770 MHz.
Figure 27A:
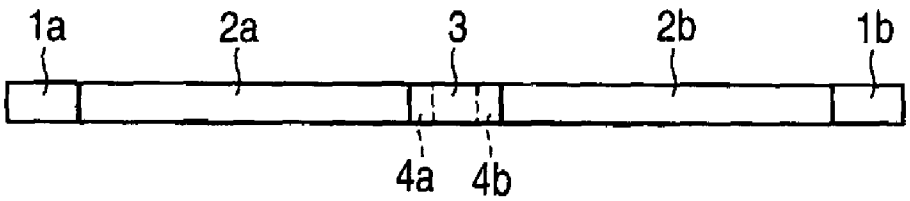
FIG. 27A is a top view of a conventional two-element type dipole antenna.
Figure 27B:
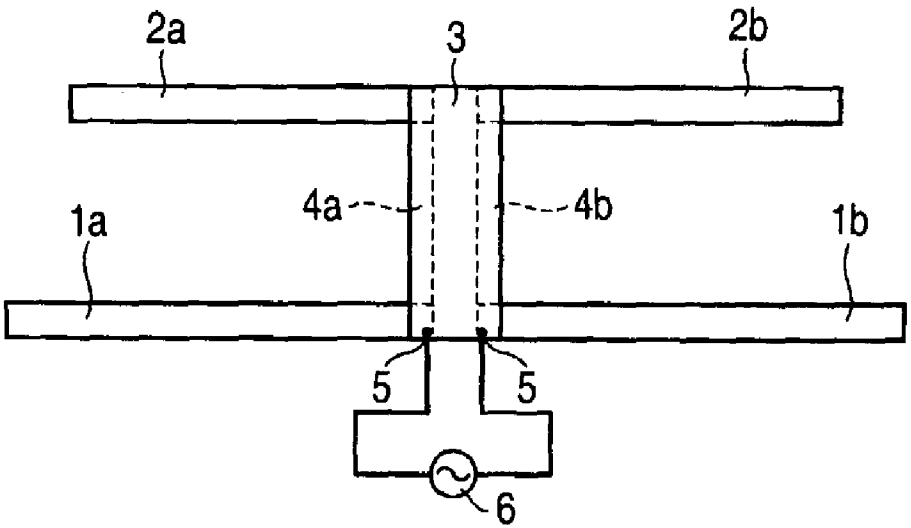
FIG. 27B is a front view of the dipole antenna of FIG. 27A.
Figure 27C:
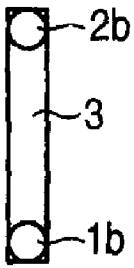
FIG. 27C is a side view of the dipole antenna of FIG. 27A.
Figure 28:
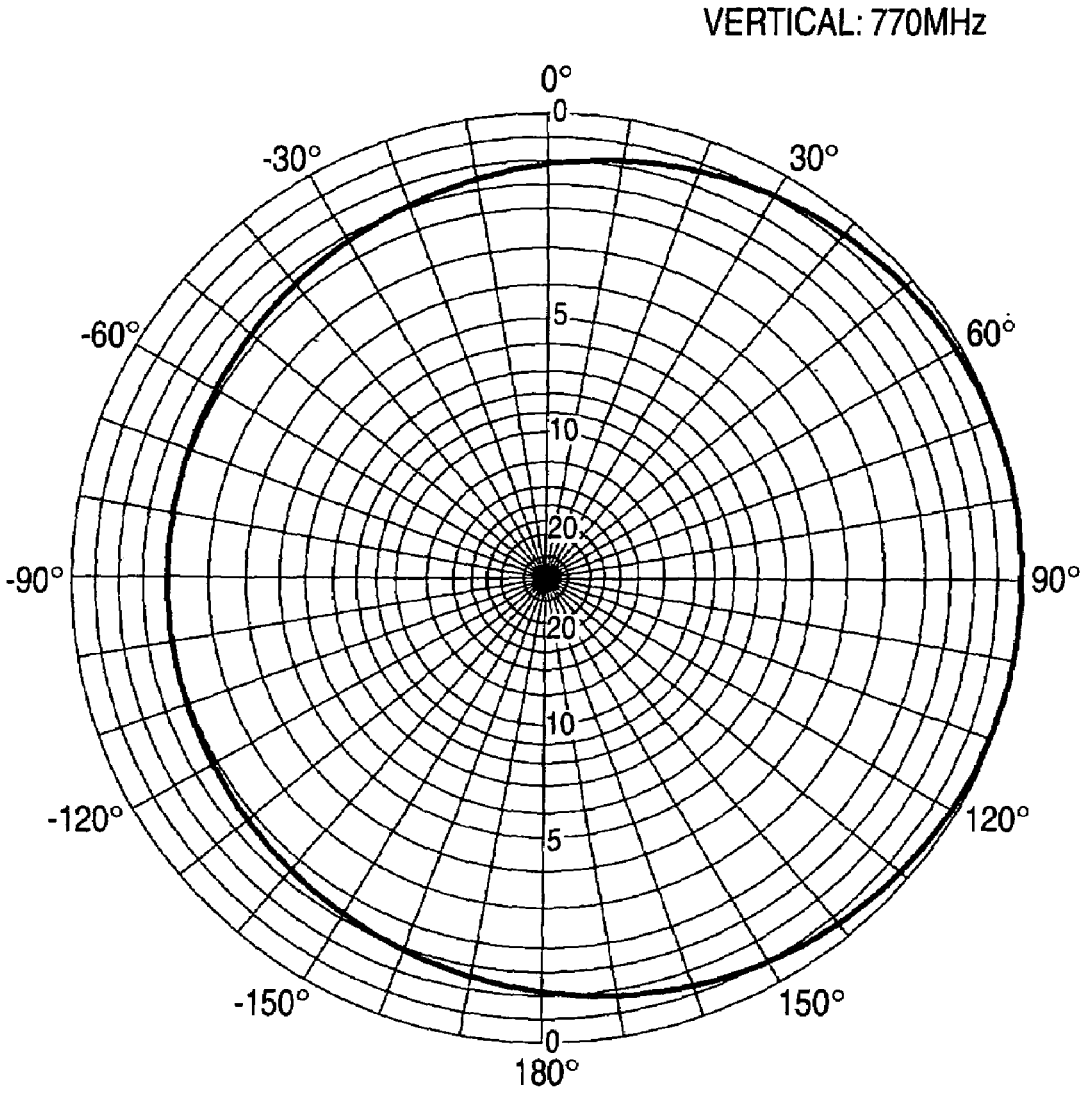
FIG. 28 is a graph showing a horizontal polarization vertical plane directivity of the dipole antenna of FIG. 27A at the frequency of 770 MHz.
Figure 29A:
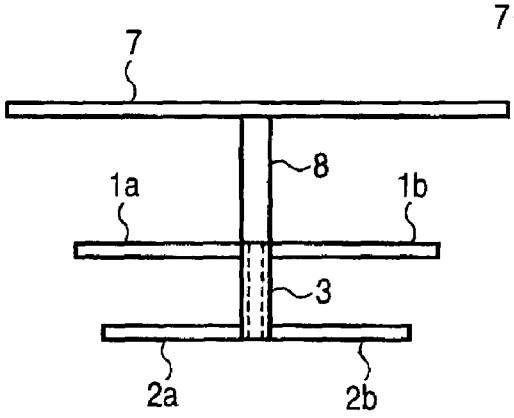
FIG. 29A is a top view of an antenna incorporating the dipole antenna of FIG. 27A as a primary driven element, showing a case that first dipole elements and second dipole elements are arranged within the same plane with respect to an electric field plane.
Figure 29B:
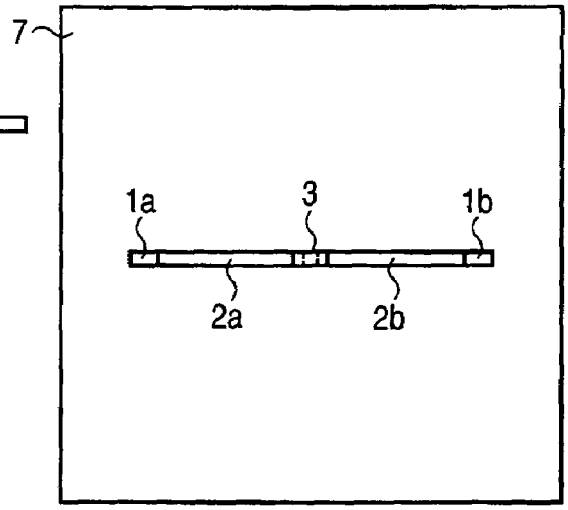
FIG. 29B is a front view of the antenna of FIG. 29A.
Figure 30A:
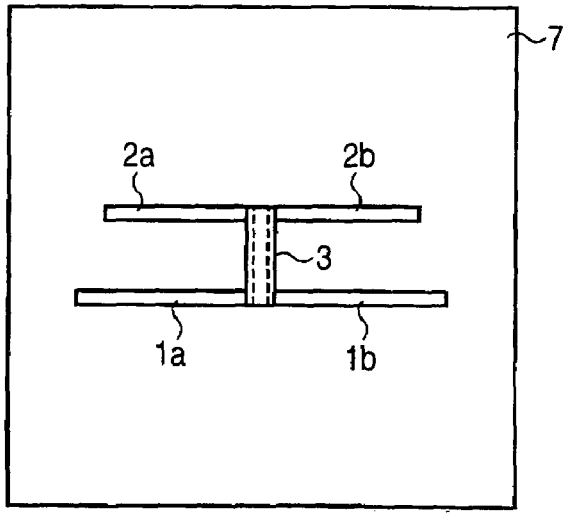
FIG. 30A is a top view of an antenna incorporating the dipole antenna of FIG. 27A as a primary driven element, showing a case that first dipole elements and second dipole elements are arranged within the same plane with respect to an electric field plane.
Figure 30B:
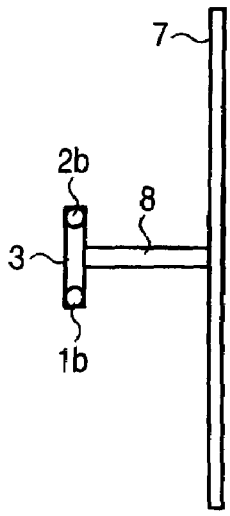
FIG. 30B is a front view of the antenna of FIG. 30A.
Figure 31:
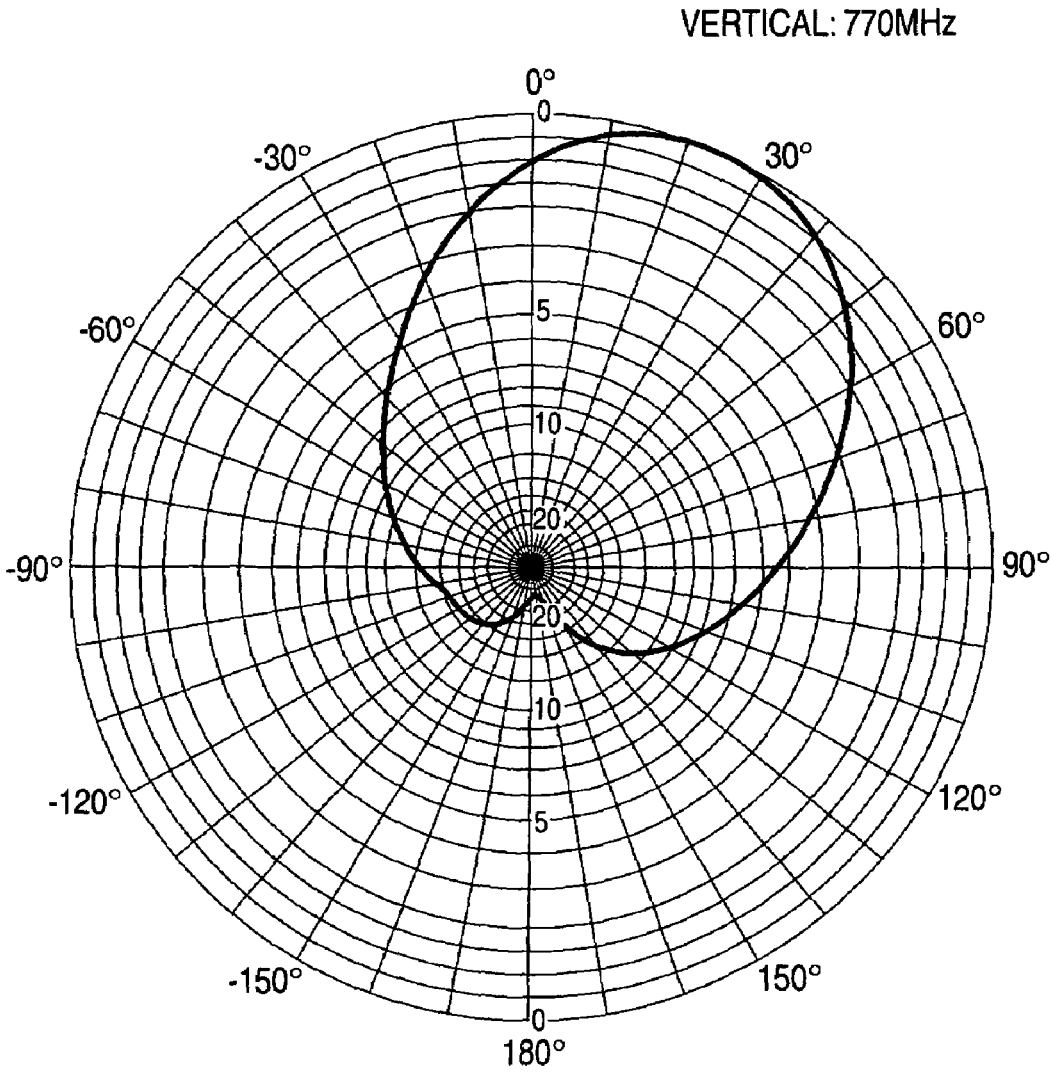
FIG. 31 is a graph showing a horizontal polarization vertical plane directivity of the antenna of FIG. 30A at the frequency of 770 MHz.

FIG. 25 shows a horizontal polarization horizontal plane directivity (polar coordinates in dB scale) at the frequency of 470 MHz of the UHF broadband antenna 10L according to the above-described 12th embodiment. FIG. 26 shows a horizontal polarization horizontal plane directivity (polar coordinates in dB scale) at the frequency of 770 MHz of this antenna 10L.

With the above configuration, a gain thereof with respect to the forward direction can be increased, and a gain thereof with respect to the backward direction can be decreased, as compared with those of the antenna 10K of the eleventh embodiment, so that an adverse influence caused by unnecessary electromagnetic waves propagated from the backward direction can be reduced.

Also, a horizontal polarization vertical plane directivity (refer to FIGS. 18 and 19) can be obtained which is substantially similar to that of the antenna 10G of the seventh embodiment, and it is possible to avoid that the maximum value direction of the directivity (vertical plane) is excessively tilted.

The third through twelfth embodiments have described such a case that the plate-shaped dipole elements 11*a*, 11*b* are used. Alternatively, as shown in FIGS. 2A to 2C, the holes 20*a*, 20*b* may be formed in the plate-shaped dipole elements 11*a*, 11*b*.

Also, the respective embodiments have described such a case that the dipole elements 11*a*, 11*b* are constituted by the metal plates. Alternatively, the dipole elements may be formed by metal foils on an antenna base plate.

It should be understood that the present invention is not limited only to the above-described embodiments, but the structural elements may be modified without departing from the scope of the present invention.

What is claimed is:

1. A UHF broadband antenna, comprising:

a pair of dipole elements, each of which is shaped into a rectangular plate;

a power feeding point, provided on each of the dipole elements; and a strip-shaped conductive element having at least one bent portion and a width which is narrower than a width of each of the dipole elements and fixed to one faces of the dipole elements.

2. The antenna as set forth in claim 1, wherein each of the dipole elements is formed with a hole at a central position thereof.

3. The antenna as set forth in claim 1, further comprising a conductive reflection plate, having a width which is wider than a width of each of the dipole elements and disposed behind the dipole elements with a gap.

4. A UHF broadband antenna, comprising:

a pair of dipole elements, each of which is shaped into a rectangular plate;

a power feeding point, provided on each of the dipole elements, wherein upper ends of the dipole elements are folded rearward to form a conductive folded element, opposite end portions of the conductive folded element are connected to the dipole elements, respectively, and a gap is provided between the pair of dipole elements and the conductive folded element.

5. The antenna as set forth in claim 4, wherein each of the dipole elements is formed with a hole at a central position thereof.

6. The antenna as set forth in claim 4, further comprising a conductive reflection plate, having a width which is wider than a width of each of the dipole elements and disposed behind the dipole elements with a gap.

* * * * *